US007983783B2

(12) United States Patent
Hayakawa

(10) Patent No.: US 7,983,783 B2
(45) Date of Patent: Jul. 19, 2011

(54) EMBROIDERY DATA CREATION APPARATUS AND EMBROIDERY DATA CREATION PROGRAM

(75) Inventor: Atsuya Hayakawa, Chita (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 1170 days.

(21) Appl. No.: 11/713,742

(22) Filed: Mar. 5, 2007

(65) Prior Publication Data

US 2007/0204780 A1 Sep. 6, 2007

(30) Foreign Application Priority Data

Mar. 6, 2006 (JP) ..... 2006-059723

(51) Int. Cl.
*D05C 5/02* (2006.01)

(52) U.S. Cl. ..... 700/138; 112/470.01

(58) Field of Classification Search ..... 700/136–138; 112/285, 300, 445, 453, 470.01, 470.06, 112/475.19
See application file for complete search history.

(56) References Cited

U.S. PATENT DOCUMENTS

| | | | | |
|---|---|---|---|---|
| 6,123,037 | A * | 9/2000 | Shimizu | 112/300 |
| 6,164,224 | A * | 12/2000 | Tachikawa et al. | 112/300 |
| 2006/0021559 | A1 * | 2/2006 | Kaiya et al. | 112/475.18 |

FOREIGN PATENT DOCUMENTS

| | | |
|---|---|---|
| JP | A 02-118154 | 5/1990 |
| JP | B2 2596095 | 1/1997 |
| JP | A 2001-17758 | 1/2001 |
| JP | A 2003-265876 | 9/2003 |
| JP | A 2005-253612 | 9/2005 |

* cited by examiner

*Primary Examiner* — Gary Welch
*Assistant Examiner* — Nathan E Durham
(74) *Attorney, Agent, or Firm* — Oliff & Berridge, PLC

(57) ABSTRACT

An embroidery data creation apparatus and program acquires closed region data of a target unit pattern with a sewing order specified by a unit pattern counter and position data of a sewing endpoint of a preceding unit pattern to be sewn immediately prior to this target unit pattern. Based on the closed region data and the position data of the sewing endpoint, it is determined whether a sewing endpoint of the preceding unit pattern is present in a sewing region of the target unit pattern. If it is determined that the sewing endpoint is present in the sewing region of the target unit pattern, thread-cutting operation at this sewing endpoint is set not to be performed. On the other hand, if it is determined that the sewing endpoint is not present in the sewing region of the target unit pattern, thread-cutting operation at this sewing endpoint is set to be performed or withheld.

18 Claims, 31 Drawing Sheets

FIG. 22

入口

FIG. 23

入川

FIG. 24

入江

FIG. 25

入地

EMBROIDERY DATA CREATION APPARATUS AND EMBROIDERY DATA CREATION PROGRAM

CROSS-REFERENCE TO RELATED APPLICATION

This application claims priority from JP 2006-059723, filed Mar. 6, 2006, the entire content of which is hereby incorporated by reference.

BACKGROUND

The present disclosure relates to an embroidery data creation apparatus for an embroidery sewing machine and embroidery data creation program recorded on a computer-readable recording medium.

Conventionally, there have been known embroidery sewing machines equipped with a function to embroider a plurality of unit patterns, each of which is made up of a character or a symbol such as an alphabetic character or numeral. In some of these embroidery sewing machines, it has been possible to either manually or automatically set thread-cutting operations of whether to cut a thread between the unit patterns, or whether the thread-cutting operation is to be performed or not. If they are specified manually, an operator would specify the setting by manual entry considering a finish of embroidery and a working efficiency.

As for an embroidery sewing machine which sets thread-cutting operation automatically, a name embroidery data creation apparatus has been proposed, which automatically determines whether to cut the thread between characters based on, for example, information of a typeface of characters (e.g., Japanese Patent Application Laid Open Publication No. 2001-17758). Further, an embroidery data creation apparatus and an embroidery data creation storage medium have been proposed which automatically specify inter-character thread-cutting setting correlated with character attributes such as a character type, a character typeface, a character size, and upper case/lower case of characters (e.g., Japanese Patent Application Laid Open Publication No. 2003-265876).

However, in a conventional embroidery sewing machine to which thread-cutting settings are entered manually, the operator needs to specify the settings considering a delicate embroidery finish and attributes such as a typeface and a size of unit patterns, thus resulting in a problem of a poor working efficiency. There has been another problem that the operator might make a mistake in determining whether thread-cutting operation is to be performed or not, or forget to specify the settings.

On the other hand, in a conventional name embroidery data creation apparatus that automatically specifies setting of thread-cutting in accordance with information of a typeface of characters, a working efficiency has been improved as compared to the case of manual setting. However, since thread-cutting settings would be specified uniformly in accordance with a typeface, thread might be cut when unit patterns are overlapped with each other and thus it is not necessary. This leads to problems of complicated thread disposal and excessive time taken for sewing.

Further, in a conventional embroidery data creation apparatus and embroidery data creation program that automatically specifies setting of thread-cutting in accordance with character attributes, the conditions can be specified finely in accordance with character attributes. However, it is necessary for the operator to create and modify information required to automatically specify the settings of thread-cutting for each of character attributes, with full knowledge of characteristics of a typeface. This has lead to a problem that significant time and labor is required.

SUMMARY

Exemplary embodiments of the broad principles herein provide an embroidery data creation apparatus and an embroidery data creation program recorded on a computer-readable recording medium that can properly and rapidly set conditions of thread-cutting between unit patterns to be sewn using an embroidery sewing machine.

Exemplary embodiments provide an embroidery data creation apparatus that creates embroidery data required to embroider a plurality of unit patterns by using an embroidery sewing machine, said apparatus including a storage device that stores said unit patterns, each of said unit patterns being made up of one character or symbol, a first determination device that determines whether a sewing endpoint exists in a sewing region of a target unit pattern, said sewing endpoint being last in sewing order of stitch points of a preceding unit pattern to be sewn immediately prior to said target unit pattern, and said target unit pattern being one of said unit patterns stored in said storage device, and a first thread-cutting setting device that, if it has been determined by said first determination device that said sewing endpoint of said preceding unit pattern exists in said sewing region of said target unit pattern, sets thread-cutting operation not to be performed by a thread-cutting mechanism in an embroidery sewing machine at said sewing endpoint of said preceding unit pattern and, if it has been determined by said first determination device that said sewing endpoint of said preceding unit pattern does not exist in said sewing region of said target unit pattern, sets thread-cutting operation to be performed or withheld.

Exemplary embodiments provide an embroidery data creation program recorded on a computer-readable recording medium that creates embroidery data required to embroider a plurality of unit patterns by using an embroidery sewing machine, said program including a storage step of storing said unit patterns, each of said unit patterns being made up of one character or symbol, a first determination step of determining whether a sewing endpoint exists in a sewing region of a target unit pattern, said sewing endpoint being last in sewing order of stitch points of a preceding unit pattern to be sewn immediately prior to said target unit pattern, and said target unit pattern being one of said unit patterns stored in said storage step; and a first thread-cutting setting step of, if it has been determined in said first determination step that said sewing endpoint of said preceding unit pattern exists in said sewing region of said target unit pattern, setting thread-cutting operation not to be performed by a thread cutting mechanism in an embroidery sewing machine at said sewing endpoint of said preceding unit pattern and, if it has been determined in said first determination step that said sewing endpoint of said preceding unit pattern does not exist in said sewing region of said target unit pattern, setting thread-cutting operation to be performed or withheld.

Exemplary embodiments provide an embroidery data creation apparatus that creates embroidery data required to embroider a plurality of unit patterns by using an embroidery sewing machine, said apparatus including a storage device that stores said unit patterns, each of said unit patterns being made up of one character or symbol, a control device that determines whether a sewing endpoint exists in a sewing region of a target unit pattern, said sewing endpoint being last in sewing order of stitch points of a preceding unit pattern to be sewn immediately prior to said target unit pattern, and said target unit pattern being one of said unit patterns stored in said storage device, and, if it has determined that said sewing endpoint of said preceding unit pattern exists in said sewing region of said target unit pattern, sets thread-cutting operation not to be performed by a thread cutting mechanism in an embroidery sewing machine at said sewing endpoint of said preceding unit pattern and, if it has determined that said sewing endpoint of said preceding unit pattern does not exist in said sewing region of said target unit pattern, sets thread-cutting operation to be performed or withheld.

BRIEF DESCRIPTION OF THE DRAWINGS

Exemplary embodiments of the disclosure will be described below in detail with reference to the accompanying drawings in which:

FIG. 22 is an explanatory illustration showing an embroidery finish of Example 2;

FIG. 23 is an explanatory illustration showing an embroidery finish of Example 3;

FIG. 24 is an explanatory illustration showing an embroidery finish of Example 4;

FIG. 25 is an explanatory illustration showing an embroidery finish of Example 5;

DETAILED DESCRIPTION OF THE EXEMPLARY EMBODIMENTS

The following will describe embodiments that employs an embroidery data creation apparatus related to the present disclosure with reference to drawings. The embroidery data creation apparatus of the present disclosure is provided to create and edit embroidery data which is supplied to an embroidery sewing machine. The embroidery data creation apparatus of the present disclosure may be incorporated into the embroidery sewing machine, or may be separately provided from it. First, its physical configuration and electrical configuration are described in each of the cases.

Figure 1:
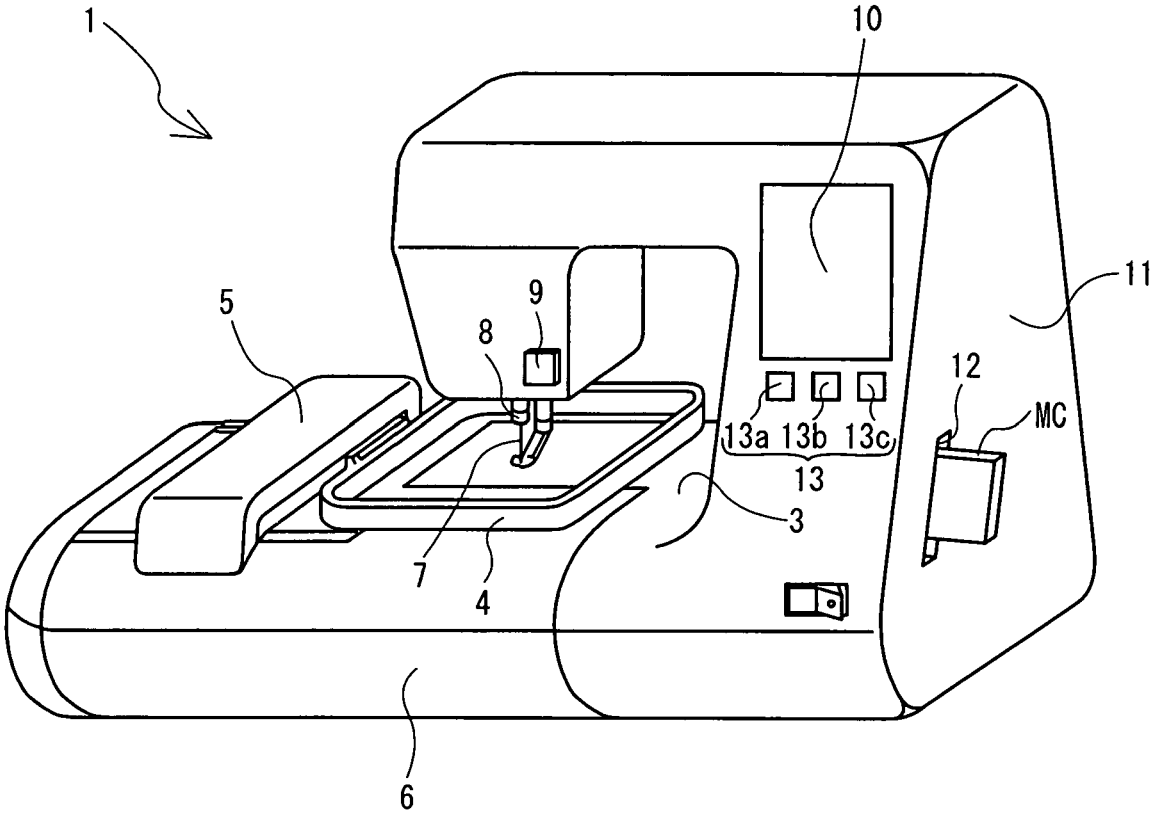
FIG. 1 is a perspective view of an embroidery sewing machine.

First, the configuration is described where the embroidery data creation apparatus is incorporated into the embroidery sewing machine, with reference to FIGS. 1-4. As shown in FIG. 1, the embroidery sewing machine 1 moves an embroidery frame 4 to a predetermined position indicated by an X-Y coordinate system specific to the apparatus by using a Y-directional drive section 5 and an X-directional drive mechanism which is housed in a body case 6. The embroidery frame 4 is arranged on a sewing machine bed 3 and holds a work cloth. While the embroidery frame 4 is moved, a predetermined pattern is embroidered on the work cloth through sewing by use of a sewing needle 7 and a loop-taker shuttle mechanism 32 (see FIG. 2). These Y-directional drive section 5, X-directional drive mechanism, sewing needle 8, etc. are controlled by a control device configured by a microcomputer etc. built into the embroidery sewing machine 1.

Further, on a side face of a pillar 11 of the embroidery sewing machine 1, a memory card slot 12 is formed. By inserting a memory card MC storing embroidery data into the memory card slot 12, the embroidery data can be separately prepared and taken in from outside. In sewing, the embroidery sewing machine 1 causes its control device to automatically perform embroidering based on embroidery data created by the incorporated embroidery data creation apparatus or embroidery data which is separately prepared and taken in from outside. It is to be noted that this embroidery data includes information which indicates color codes, embroidery positions and sizes, closed region data, sewing orders, stitch points (needle drop points), settings of thread-cutting, etc.

Further, on a front face of the pillar 11, a liquid crystal display (LCD) 10 capable of color display is mounted. This LCD 10 displays a variety of stitch patterns such as a unit pattern comprised of a character or a symbol and an embroidery pattern, function names of a variety of functions required in sewing, and even a variety of messages etc. Below the LCD 10, entry buttons 13 are provided, each of which (13*a*-13*c*) corresponds to each of the stitch pattern, the function name, or the message etc. indicated on the LCD 10. By selecting these entry buttons 13, it is made possible to enter various commands for selection of the unit patterns, numeral settings, etc. indicated on the LCD 10.

Figure 2:
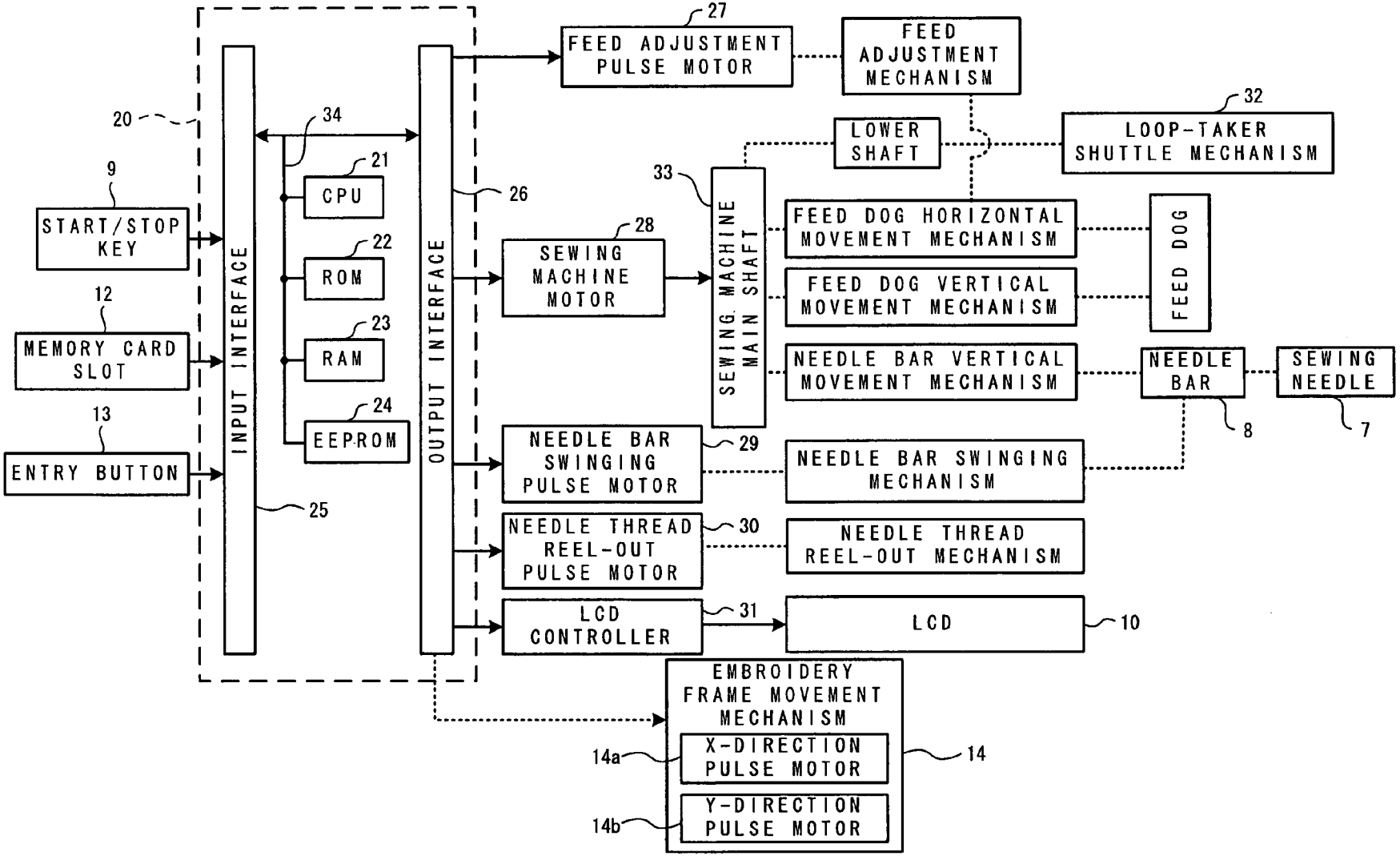
FIG. 2 is a block diagram showing a electrical configuration of the embroidery sewing machine.

Next, the electrical configuration of the embroidery sewing machine 1 is described with reference to FIG. 2. As shown in FIG. 2, an main frame 20 of this embroider sewing machine 1 is configured by a CPU 21, a ROM 22, a RAM 23, an EEPROM 24, an input interface 25, an output interface 26, etc., which are connected to each other through a bus 34. To the input interface 25, a start/stop key 9 which commands the embroidery sewing machine 1 to actuate and stop sewing, the above-described memory card slot 12 and entry buttons 13, etc. are connected. To the output interface 26, a feed adjustment pulse motor 27, a sewing machine motor 28, a needle bar swinging pulse motor 29, a needle thread reel-out pulse motor 30, an LCD controller 31, an embroidery frame moving mechanism 14, etc. are connected. The sewing machine motor 28 drives a main shaft 33 of the sewing machine rotationally. The needle bar swinging pulse motor 29 drives a needle bar 8. The LCD controller 31 drives and controls the LCD 10. The embroidery frame moving mechanism 14 is configured by an X-direction pulse motor 14*a* which drives the X-directional drive mechanism and a Y-direction pulse motor 14*b* which drives the Y-directional drive section 5 (FIG. 1).

The CPU 21 provides main control on the embroidery sewing machine 1, to perform a variety of operations and processing items in accordance with an embroidery data creation program stored in an embroidery data creation program storage area 225 (see FIG. 3) in the ROM 22, which is a read only memory. It is to be noted that the embroidery data creation program may be stored in an external memory such as a memory card, in which case this program is read into the RAM 23 to be executed.

Figure 3:
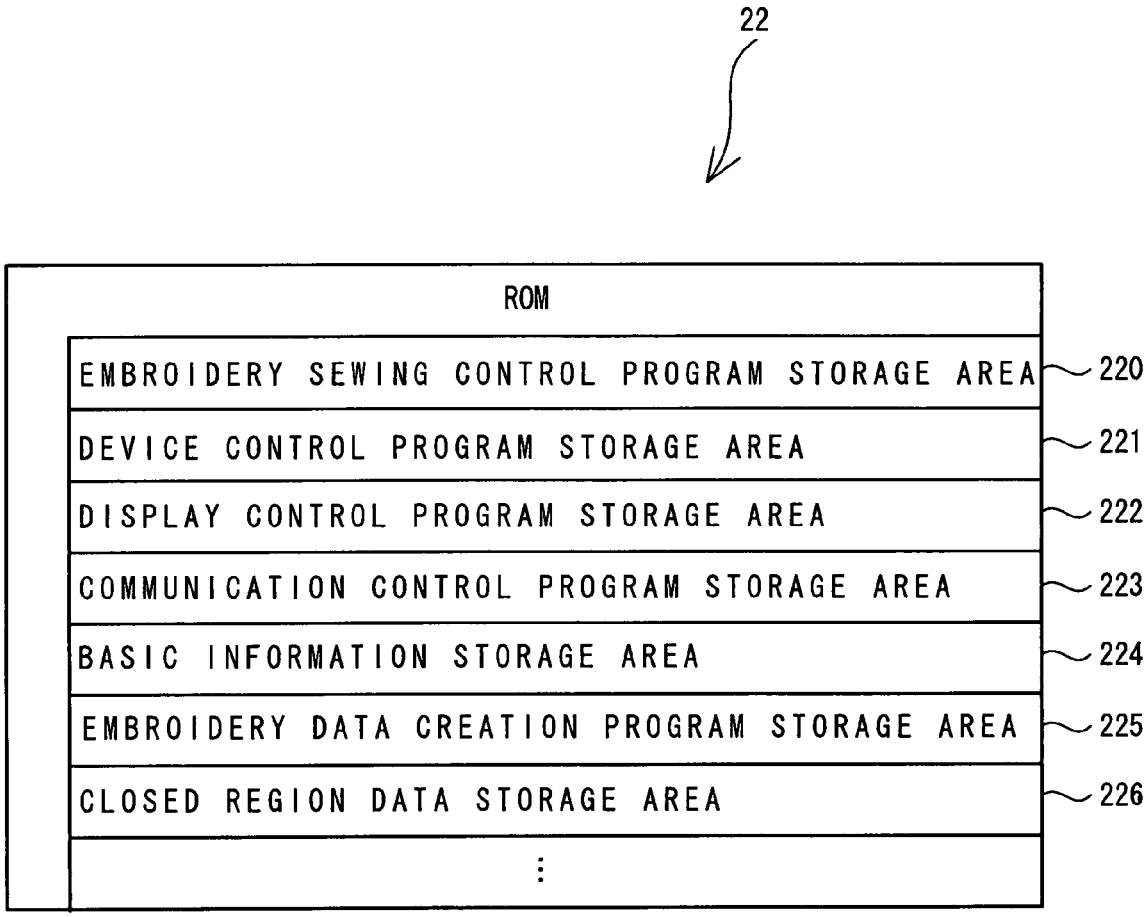
FIG. 3 is an explanatory diagram of storage areas of a ROM.
Figure 4:
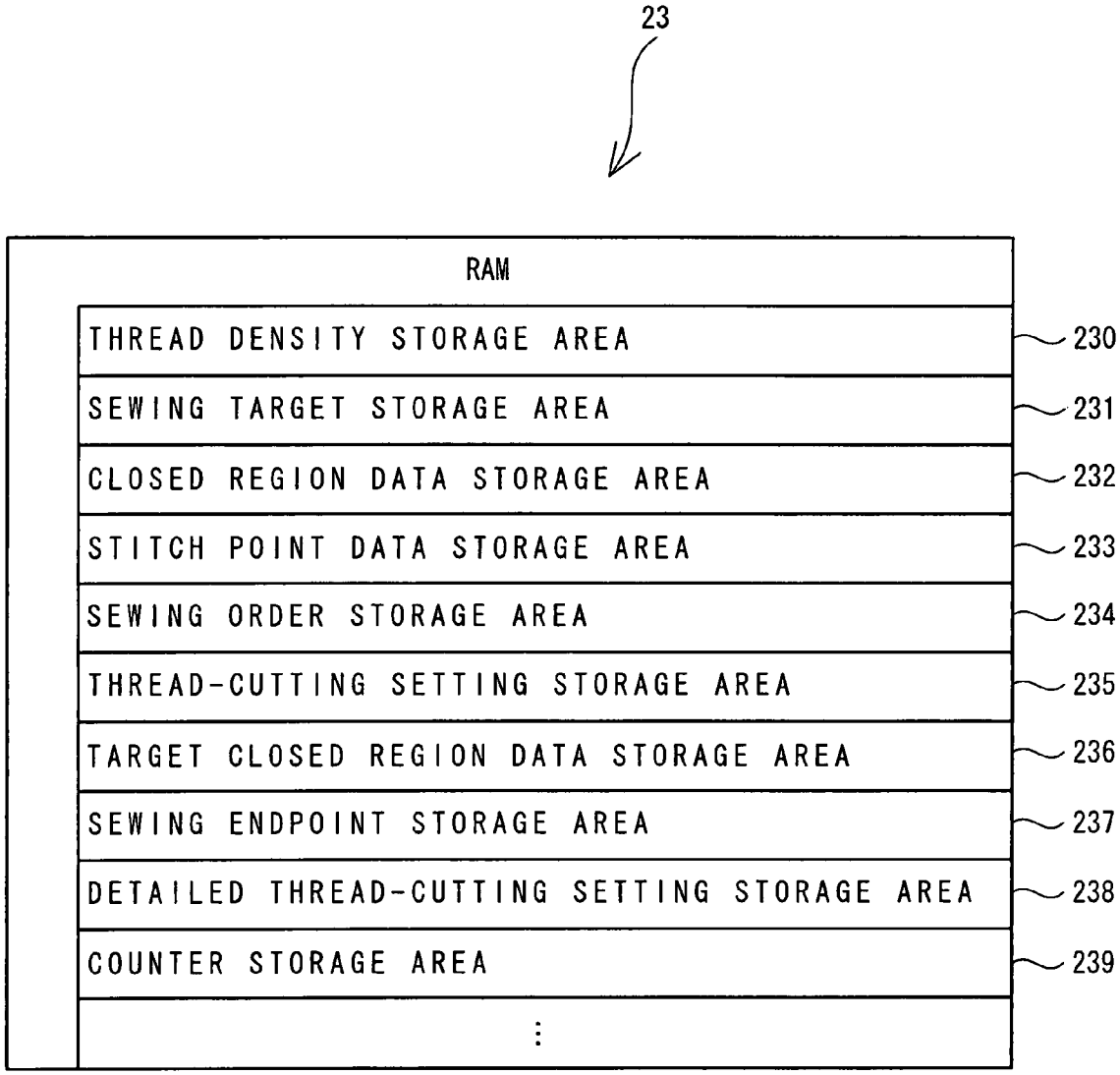
FIG. 4 is an explanatory diagram of storage areas of a RAM.

The ROM 22 has storage areas that store programs and data required to operate the embroidery sewing machine 1 based on embroidery data. The following will describe the ROM 22 in detail with reference to FIG. 3. As shown in FIG. 3, the ROM 22 has: an embroidery sewing control program storage area 220; a device control program storage area 221; a display control program storage area 222; a communication control program storage area 223; a basic information storage area 224; the embroidery data creation program storage area 225; and a closed region data storage area 226. The embroidery sewing control program storage area 220 stores a program that drives and controls various devices required in embroidery sewing. The device control program storage area 221 stores a program that controls various devices to be controlled not in the case of sewing. The display control program storage area 222 stores a program that controls the LCD 10. The communication control program storage area 223 stores a program, which exchanges commands and data with the embroidery data creation apparatus, provided separately from the embroidery sewing machine 1. The basic information storage area 224 stores model information of the embroidery sewing machine 1, size information of a sewing region, etc. The embroidery data creation program storage area 225 stores an embroidery data creation program of the present disclosure. The closed region data storage area 226 stores beforehand the closed region data corresponding to a variety of unit patterns, which is required to create embroidery data. The closed region data is a position data which specifies coordinates of each of vertexes of simple polygons (squares, for example), which are obtained by dividing a graphic of an embroidery pattern. The closed region data is stored in the closed region data storage area 226. The closed region data is of a technology proposed with an embroidery data creation apparatus in, for example, Japanese Patent Application Laid Open Publication No. Hei 5-7676. It is to be noted that these position data pieces may be of relative coordinates or absolute coordinates as far as they can be compared to each other.

The RAM 23, which is a random access memory, has storage areas that store data required to create embroidery data. The RAM 23 is detailed with reference to FIG. 4. The RAM 23 has: a thread density storage area 230; a sewing target storage area 231; a closed region data storage area 232; a stitch point data storage area 233; a sewing order storage area 234; a thread-cutting setting storage area 235; a target closed region data storage area 236; a sewing endpoint storage area 237; a detailed thread-cutting setting storage area 238; and a counter storage area 239. The thread density storage area 230 stores a thread density of a sewing region. The sewing target storage area 231 stores a sewing target. The closed region data storage area 232 stores closed region data corresponding to a sewing target. The stitch point data storage area 233 stores stitch points data calculated from the closed region data and a thread density by a well-known method. The sewing order storage area 234 stores the order in which closed region data pieces and stitch points are sewn. The thread-cutting setting storage area 235 stores settings of thread-cutting of unit patterns of a sewing target. The target closed region data storage area 236 stores closed region data of a target unit pattern. The sewing endpoint storage area 237 stores a sewing endpoint of a unit pattern that precedes the target unit pattern. The detailed thread-cutting setting storage area 238 stores the information whether the thread is to be cut or the determination is to be withheld. The counter storage area 239 stores a counter used to refer to unit patterns of a sewing target in accordance with the sewing order.

This embroidery sewing machine 1, which has functions as an embroidery data creation apparatus of the present disclosure, is configured to create embroidery data which is used to specify stitch points and settings of thread-cutting when embroidering a work cloth with a predetermined graphic.

Next, a configuration of the embroidery data creation apparatus, which is provided separately from the embroidery sewing machine 1, is described with reference to FIGS. 5-8.

Figure 5:
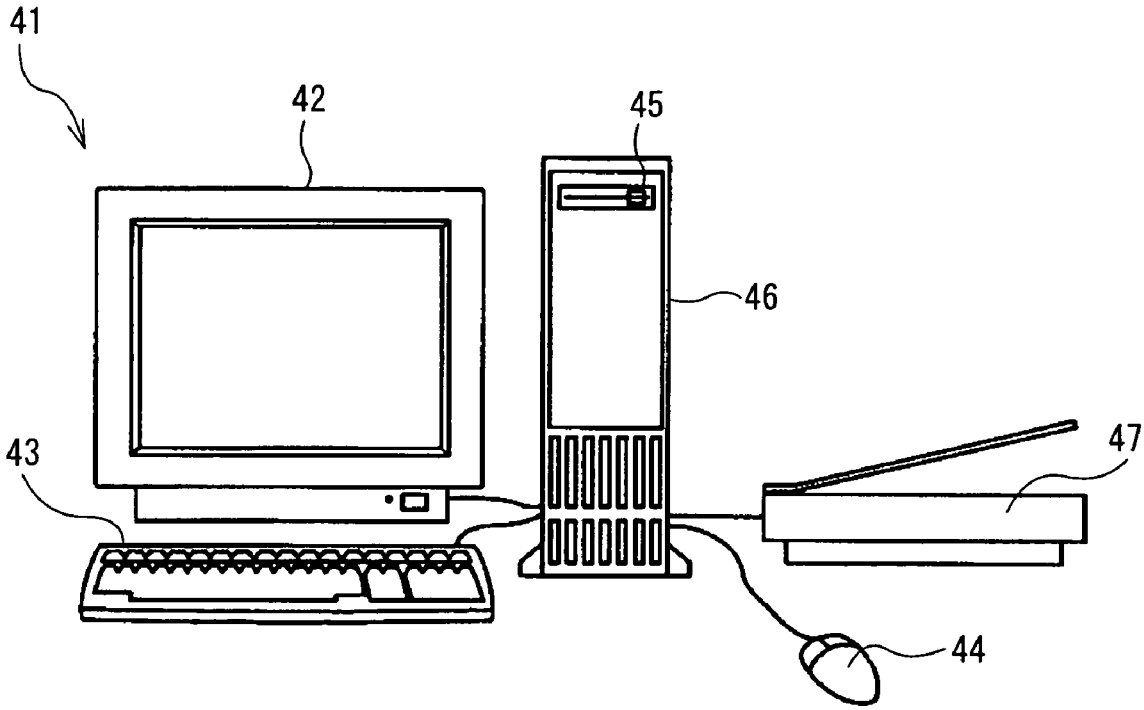
FIG. 5 is an overall configuration diagram showing a physical configuration of an embroidery data creation apparatus.

First, a physical configuration of an embroidery data creation apparatus 41 is described with reference to FIG. 5. As shown in FIG. 5, this embroidery data creation apparatus 41 is used to create and edit embroidery data which is to be supplied to the embroidery sewing machine 1. Basically, it is configured by a main frame 46 and components connected to the main frame 46: a display apparatus 42; a keyboard 43; a mouse 44; a memory card connector 45; and an image scanner 47.

Figure 6:
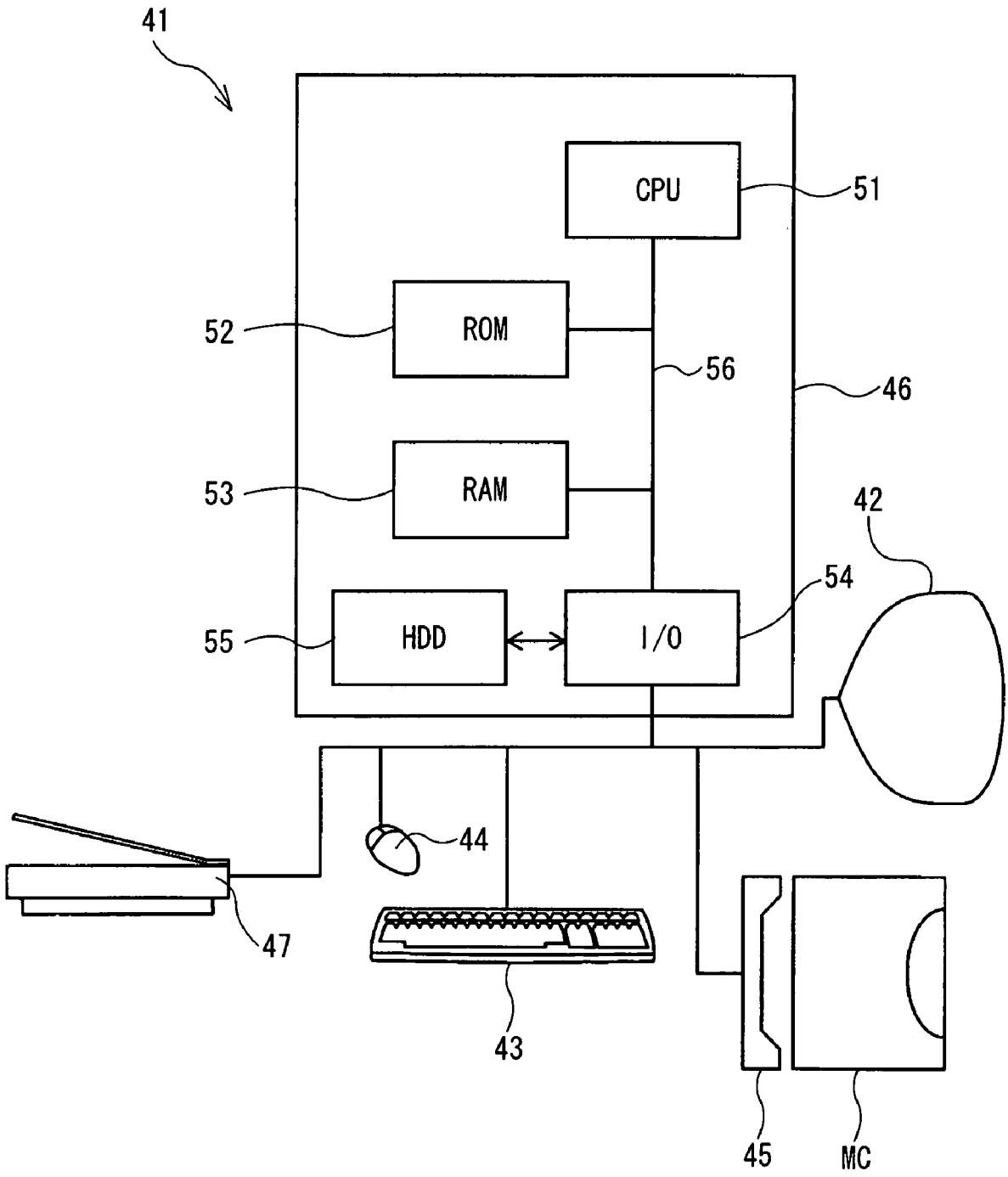
FIG. 6 is a block diagram showing an electrical configuration of the embroidery data creation apparatus.

Next, an electrical configuration of the embroidery data creation apparatus 41 is described with reference to FIG. 6. As shown in FIG. 6, the main frame 46 comprises a CPU 51, a ROM 52, a RAM 53, an I/O interface 54, and a hard disk drive (HDD) 55, which are connected to each other via a bus 56. To the I/O interface 54, the display apparatus 42, the keyboard 43, the mouse 44, the memory card connector 45, and the image scanner 47 are connected. MC stands for a memory card which can be connected to the memory card connector 45.

The CPU 51 performs various operations and processing items in accordance with the embroidery data creation program stored in an embroidery data creation program storage area 525 in the ROM 52, which is a read only memory. It is to be noted that if the main frame 46 is a dedicated device, the program is stored in the ROM 52. On the other hand, if it is a general purpose one (personal computer etc.), the program stored in the hard disk 55 etc. is read into the RAM 53 to be executed.

Figure 7:
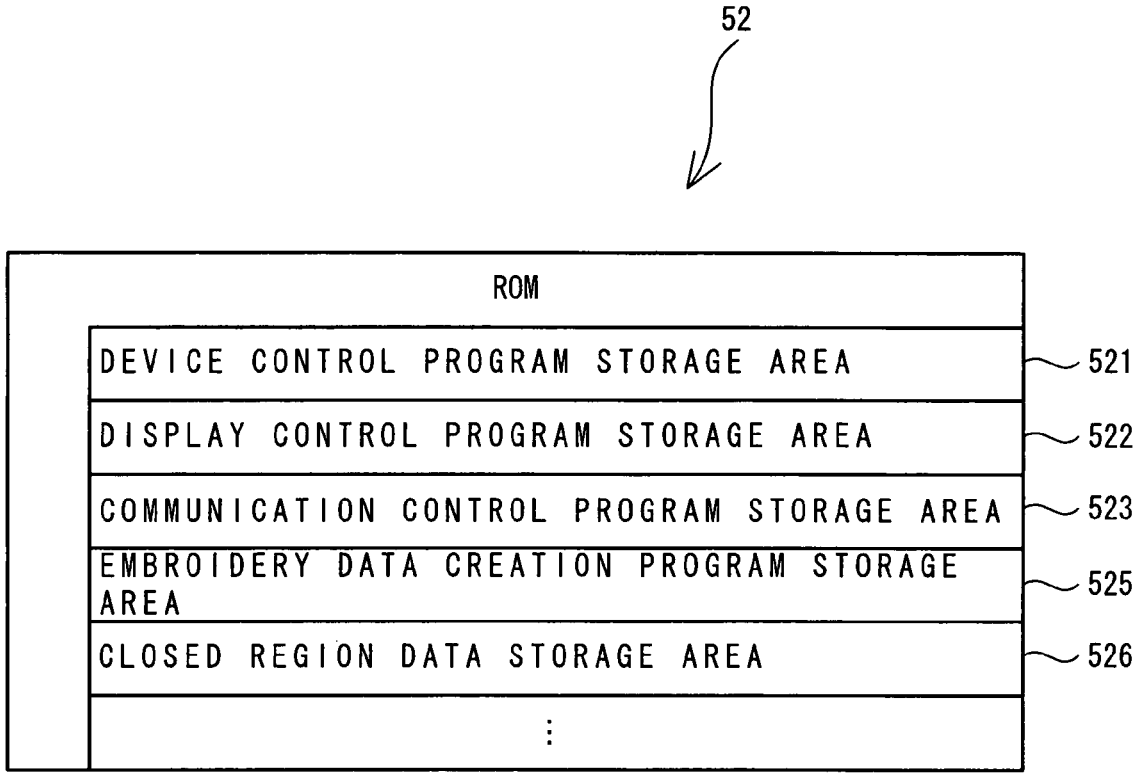
FIG. 7 is an explanatory diagram of storage areas of the ROM.
Figure 8:
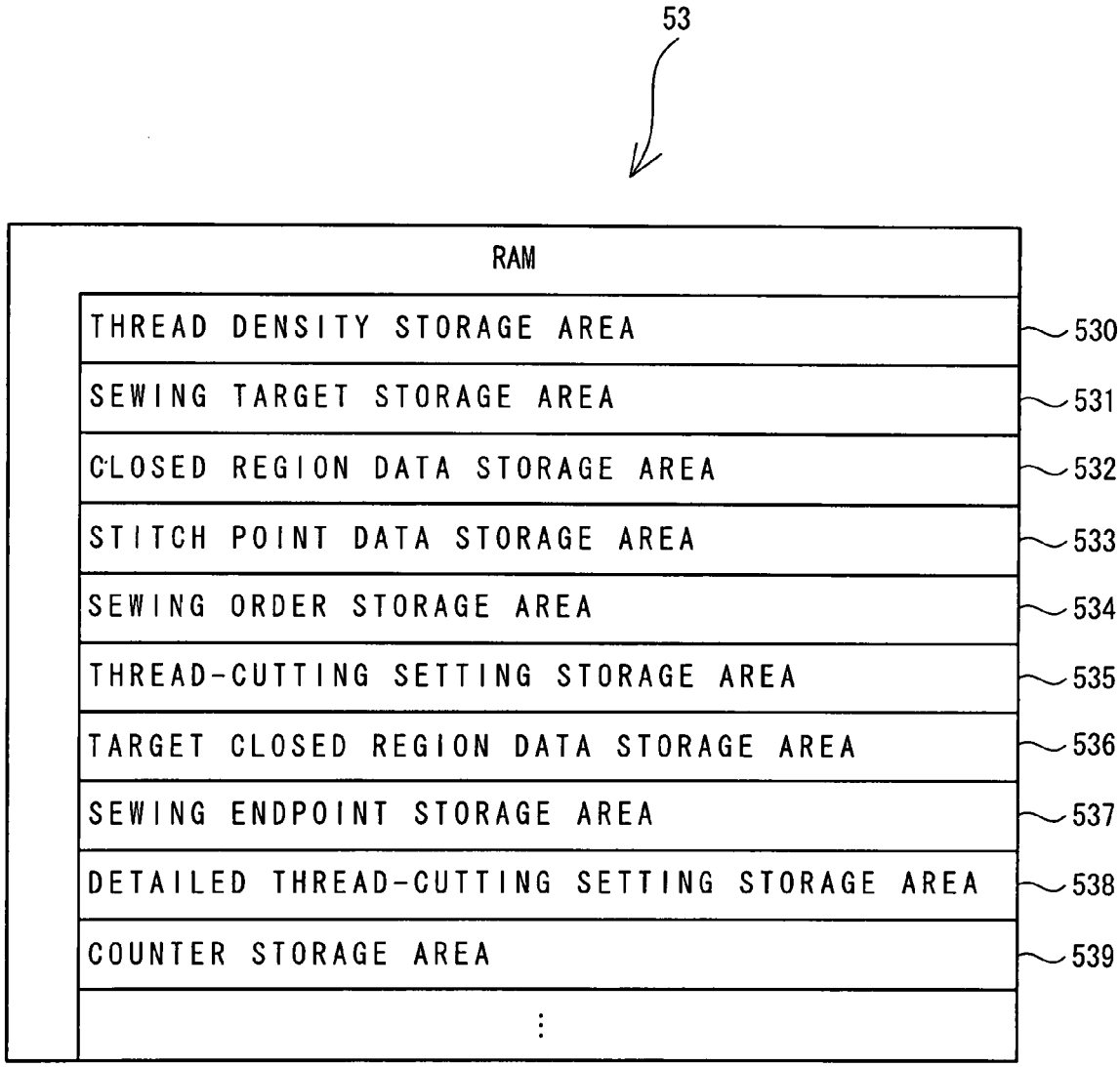
FIG. 8 is an explanatory diagram of storage areas of the RAM.

The ROM 52 has storage areas which store programs and data required to create embroidery data. The following will describe the ROM 52 in detail with reference to FIG. 7. As shown in FIG. 7, the ROM 52 has: a device control program storage area 521; a display control program storage area 522; a communication control program storage area 523; an embroidery data creation program storage area 525; a closed region data storage area 526, etc. The device control program storage area 521 stores a program which controls various devices such as the keyboard 43, the mouse 44, the memory card connector 45, and the image scanner 47. The display control program storage area 522 stores a program which controls the display apparatus 42. The communication control program storage area 523 stores a program which exchange commands and data with the embroidery sewing machine 1. The embroidery data creation program storage area 525 stores the embroidery data creation program related to the present disclosure. The closed region data storage area 526 stores closed region data corresponding to unit patterns required to cerate embroidery data, for each of attributes such as a typeface and a size.

The RAM 53, which is a random access memory, has storage areas which store data required to create embroidery data. The RAM 53 is detailed with reference to FIG. 8. The RAM 53 has: a thread density storage area 530; a sewing target storage area 531; a closed region data storage area 532; a stitch point data storage area 533; a sewing order storage area 534; a thread-cutting setting storage area 535; a target closed region data storage area 536; a sewing endpoint storage area 537; a detailed thread-cutting setting storage area 538; and a counter storage area 539, etc. The thread density storage area 530 stores a thread density of a sewing region. The sewing target storage area 531 stores a sewing target. The closed region data storage area 532 stores closed region data corresponding to a sewing target. The stitch point data storage area 533 stores stitch points data calculated from closed region data and a thread density by a well-known method. The sewing order storage area 534 stores the order in which closed region data pieces and stitch points are sewn. The thread-cutting setting storage area 535 stores settings of thread-cutting of unit patterns of a sewing target. The target closed region data storage area 536 stores closed region data of a target unit pattern. The sewing endpoint storage area 537 stores a sewing endpoint of a unit pattern which precedes the target unit pattern. The detailed thread-cutting setting storage area 538 stores the information whether the thread is to be cut or the determination is to be withheld. The counter storage area 539 stores a counter used to refer to unit patterns of a sewing target in accordance with the sewing order.

Figure 11:
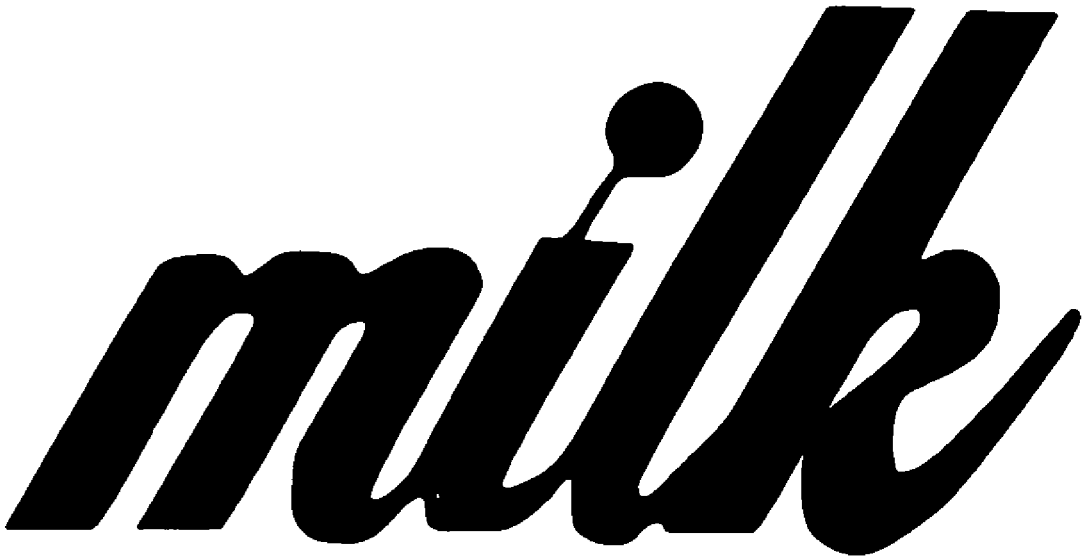
FIG. 11 is an explanatory illustration showing an embroidery finish of Example 1.
Figure 12:
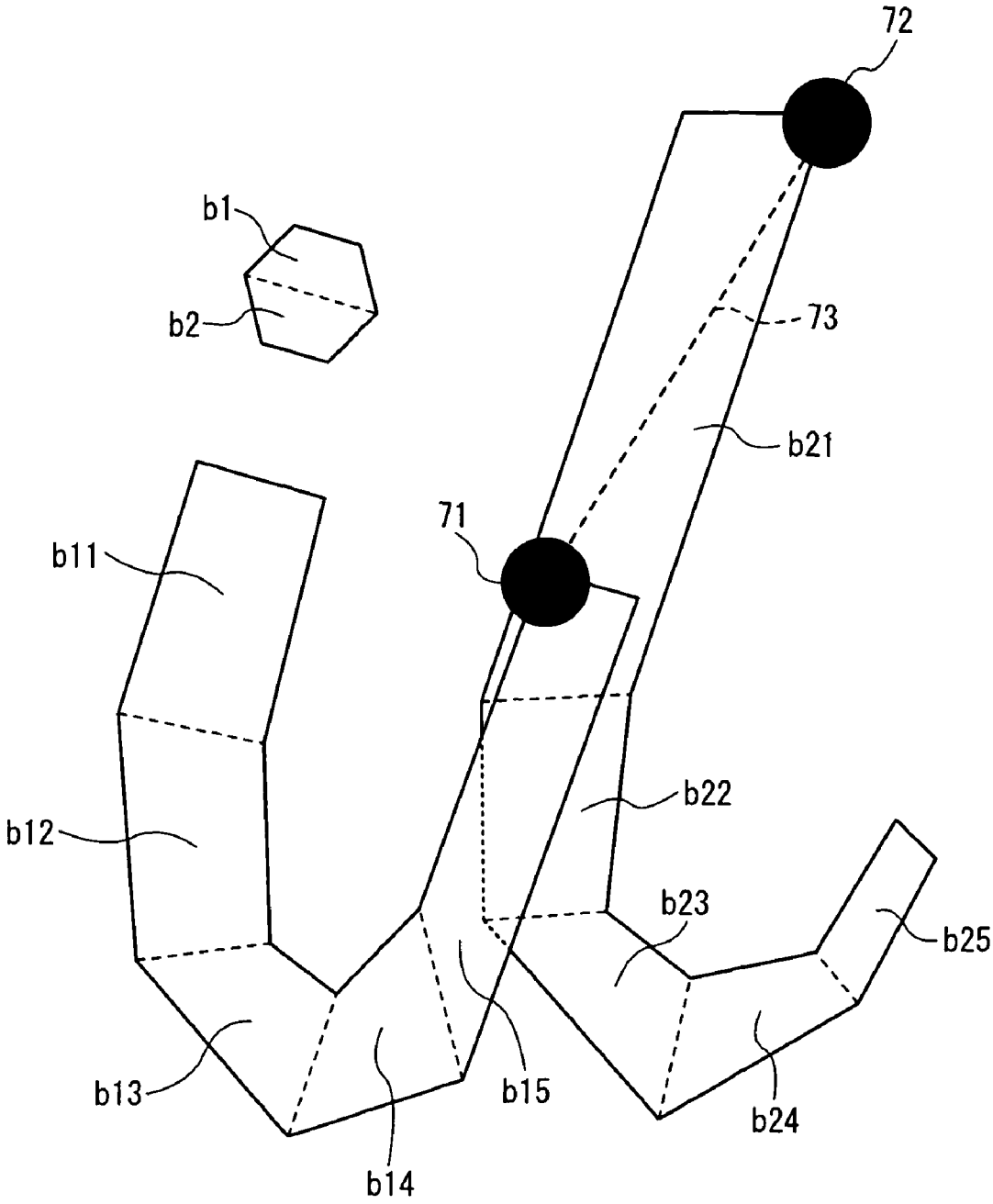
FIG. 12 is an explanatory illustration of sewing regions represented by closed region data of several unit patterns, which constitute a part of Example 1.

Next, a processing procedure for creating embroidery data of Example 1 by the above-described embroidery data creation apparatus 41 is described, with reference to the drawings. First, Example 1, in which "milk" is embroidered in italic characters, is described with reference to FIGS. 11 and 12. It is assumed that the characters of the Example 1 "milk" shown in FIG. 11 are sequentially sewn starting from the leftmost one. FIG. 12 illustrates sewing regions represented by the closed region data of "i" which is a unit pattern that comes second and that of "l" which is a unit pattern that comes third in sewing order.

The closed region data is stored in the ROM 52 as, for example, data which specifies coordinates that indicate each of vertexes of simple squares, which are obtained by dividing a graphic of an embroidery pattern. Four points (vertexes) of each squares are referred to as a first point, a second point, a third point, and a fourth point in order in which they are stored. In this case, a stitching direction may be reversed along a line segment interconnecting the first and third points and a line segment interconnecting the second and fourth points. These line segment interconnecting the first and third points and line segment interconnecting the second and fourth points are each referred to as a main side. On the other hand, a line segment interconnecting the first and second points and a line segment interconnecting the third and fourth points are each referred to as a subordinate side.

In FIG. 12, a sewing region of each of the unit patterns "i" and "l" is divided into squares, each of which is enclosed by four points. In FIG. 12, a solid line indicates the main side and a broken line indicates the subordinate side generated by dividing the embroidery pattern into a plurality of squares. In FIG. 12, b1, b2, b11, b12, b13, b14, and b15 each indicates a sewing region represented by the closed region data of the unit pattern "i", while b21, b22 b23, b24, and b25 each indicates a sewing region represented by closed region data of the unit pattern "l". Further, in FIG. 12, a point 71 indicates a sewing endpoint of the unit pattern "i" and a point 72 indicates a sewing starting point of the unit pattern "l".

Figure 9:
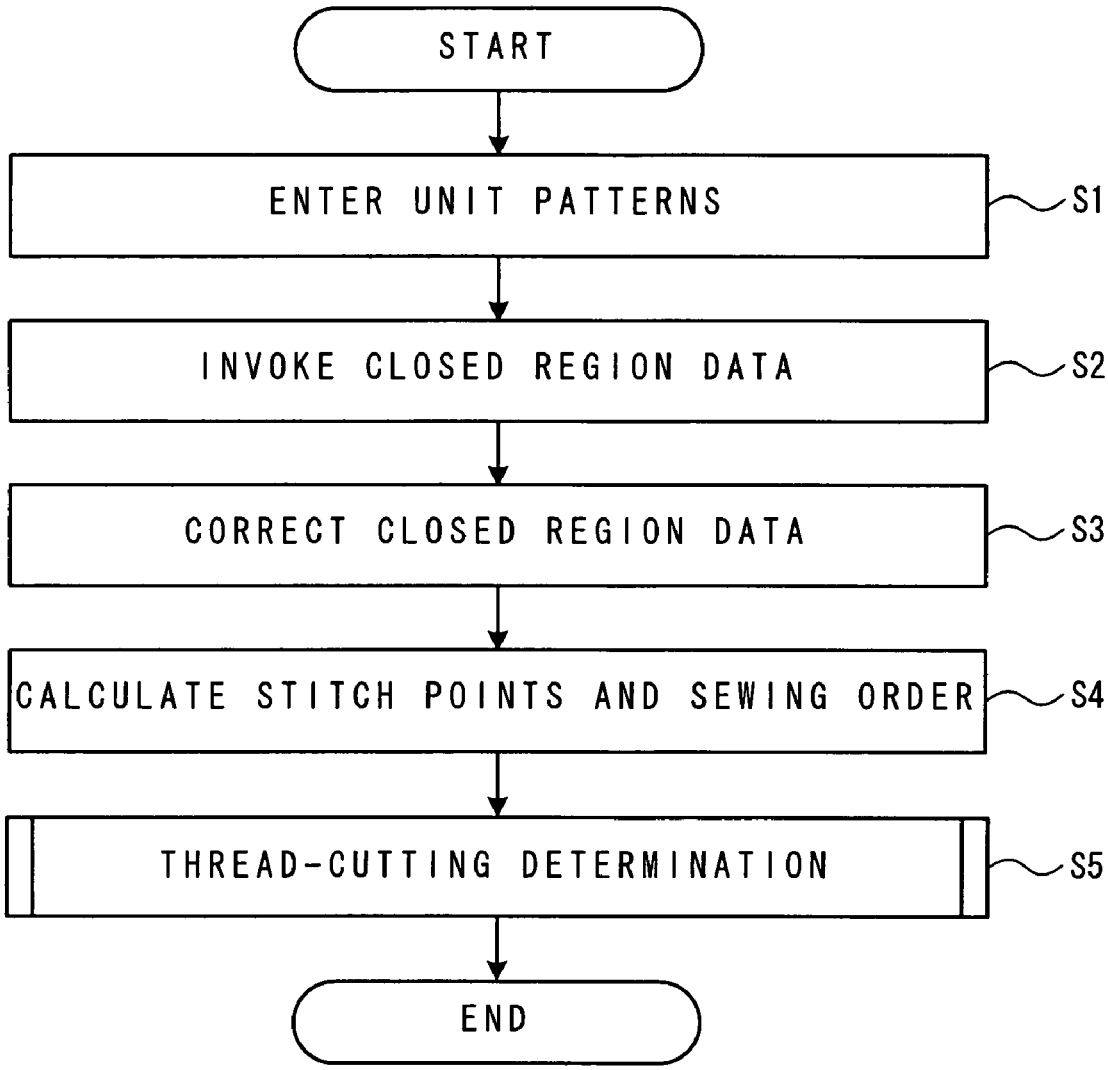
FIG. 9 is a main flowchart showing a flow of main processing of embroidery data creation.
Figure 10:
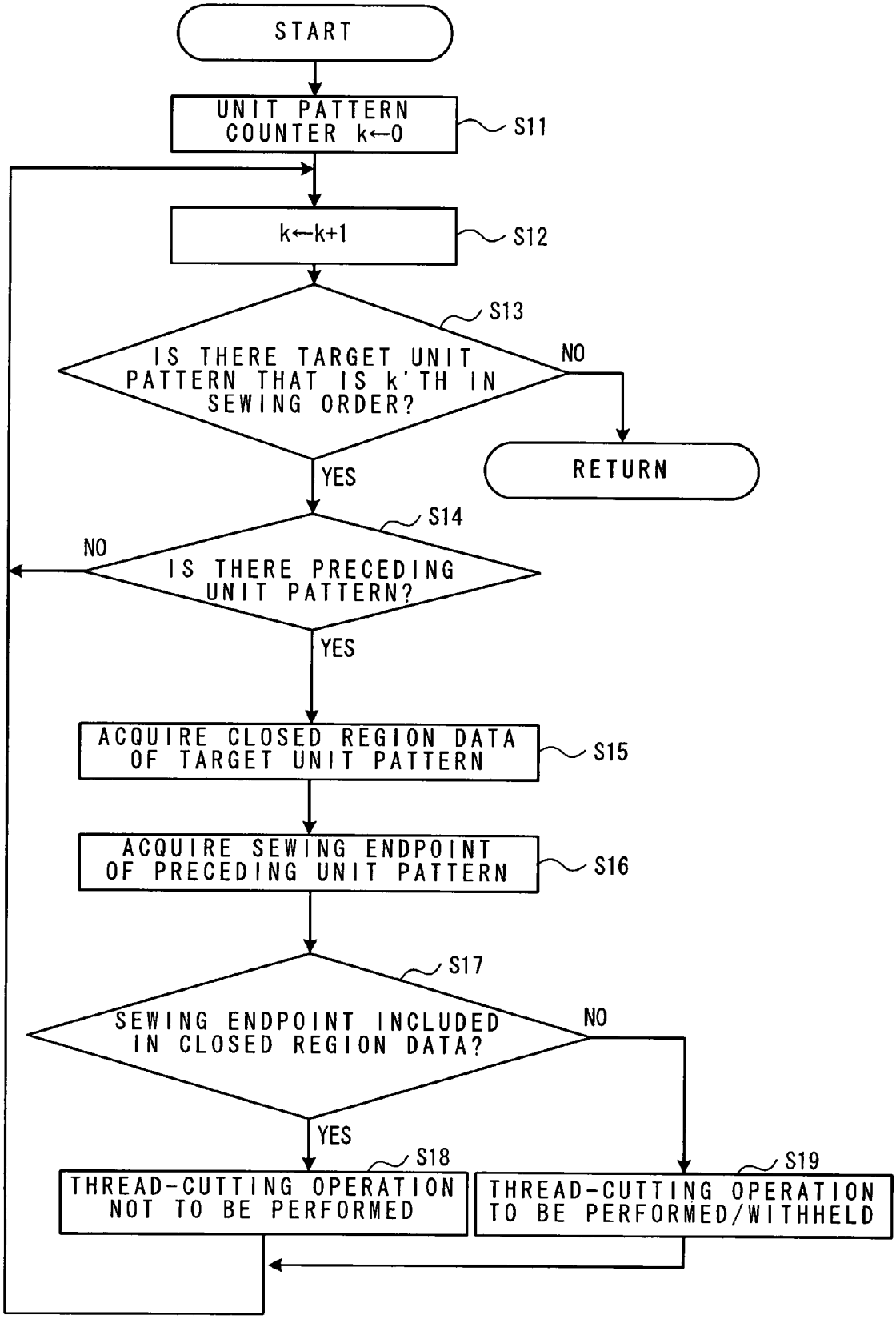
FIG. 10 is a flowchart showing a flow of setting of thread-cutting operations.

Next, a processing procedure is described for creating embroidery data of Example 1 of "milk", with reference to FIGS. 9 and 10. The program that performs a main processing shown in FIG. 9 and a thread-cutting determination shown in FIG. 10 is stored beforehand in the embroidery data creation program storage area 525 in the ROM 52 and executed by the CPU 51 shown in FIG. 6.

As shown in FIG. 9, when the main processing starts, first the alphabetic characters of "milk" in italics are entered into the main frame 46 by an operator, using the keyboard 43 and the mouse 44 (S1). Example 1 of "milk" thus entered is stored in the sewing target storage area 531 in the RAM 53. Subsequently, the closed region data of each of unit patterns constituting the entered Example 1 of "milk" is invoked from the closed region data storage area 526 in the ROM 52 (S2). Then, this closed region data is corrected by a well-known method in accordance with attributes such as a width, a height, and a rotation of each of the unit patterns to be sewn (S3). The post-correction closed region data is stored in the closed region data storage area 532 in the RAM 53.

Subsequently, by means of a well-known method, stitch points are calculated for each sewing region enclosed by four points included in the closed region data, based on a thread density stored in the thread density storage area 530 in the RAM 53 (S4). The data of thus calculated stitch points and the sewing order of the unit patterns and the stitch points are respectively stored in the stitch point data storage area 533 and the sewing order storage area 534 in the RAM 53. Then, whether a thread-cutting operation is to be performed is determined and set for each of the unit patterns to be sewn, in the thread-cutting determination step (S5), to end the main processing. The thread-cutting determination step in S5 will hereinafter be described in detail with reference to FIG. 10. It is to be noted that, as for Example 1 of "milk", data recoded in the memory card may be taken into the embroidery data creation apparatus 41 from the memory card connector 45, rather than by being entered by the operator.

Next, how to determine whether or not a thread-cutting operation is performed is described, with reference to the flowchart shown in FIG. 10. In the following case to be described, the unit pattern of "l" that is third in the sewing order is supposed to be a target unit pattern and "i" is supposed to be the preceding unit pattern of the four unit patterns of Example 1 of "milk" (k=3 at S12).

In S11, to initialize a unit pattern counter k used to refer to the unit patterns of a sewing target in accordance with the sewing order, the unit pattern counter k is set to 0 and the value of k is stored in the counter storage area 539. Subsequently, in S12, the unit pattern counter k is incremented by 1, the value of k is then stored in the counter storage area 539. This processing enables referring to the unit patterns of the sewing target in accordance with the sewing order. It is to be noted that in the following description with Example 1, descriptions of S11 and S12 will be omitted.

First, to identify a target unit pattern and a preceding unit pattern which is to be processed in the first embodiment, the CPU 51 determines in S13 whether there is any target unit pattern that is k'th in sewing order (S13). For Example 1, the target unit pattern of "l" that is third in the sewing order is previously stored in the sewing target storage area 531. Therefore, it is determined that there is a target unit pattern (YES in S13). On the other hand, when the CPU 51 refers to the sewing target storage area 531 in the RAM 53 and determines that there is no target unit pattern that is k'th in sewing order stored (NO at S13), the CPU 51 determines that the processing has completed for all of the unit patterns and ends the thread-cutting determination processing. Then, it returns to the main flowchart shown in FIG. 9, to end the main processing of embroidery data creation.

If it is determined that there is a target unit pattern (YES in S13), the CPU 51 then refers to the sewing target storage area 531 and determines whether there is a preceding unit pattern, which is to be sewn immediately prior to the target unit pattern (S14). For Example 1, the unit pattern of "i" that is second in sewing order is stored beforehand in the sewing target storage area 531, the CPU 51 therefore determines that there is a preceding unit pattern (YES at S14). The above processing in S13 and S14 identifies the target unit pattern of "l" and the preceding unit pattern of "i" which are to be processed in the first embodiment. On the other hand, if a unit pattern that is (k−1)' the in the sewing order has not been stored in the sewing target storage area 531, the CPU 51 determines that there is no preceding unit pattern (NO at S14) and returns to S12 in order to perform a thread-cutting determination on a target unit pattern that comes next in the sewing order and the corresponding preceding unit pattern.

Subsequently, the CPU 51 acquires closed region data of a target unit pattern stored in the closed region data storage area 532 in the RAM 53 (S15) and stores it in the target closed region data storage area 536. This closed region data is used to determine whether any part of the preceding unit pattern exists in the sewing region of the target unit pattern. For Example 1, a set of closed region data is acquired of the target unit pattern of "l" represented by the sewing regions b21, b22, b23, b24, and b25 shown in FIG. 12 (S15). Subsequently, the position data of a stitch point that is last in the sewing order is acquired as position data of a sewing endpoint from those stitch points of the preceding unit pattern stored in the stitch point data storage area 533 in the RAM 53 (S16) and stored in the sewing endpoint storage area 537. The sewing order of the stitch points stored in the stitch point data storage area 533 is previously stored in the sewing order storage area 534. Therefore, the position data of the stitch point that is last in sewing order is identified from the stitch points stored in the stitch point data storage area 533 and sewing order of these stitch points stored in the sewing order storage area 534. For Example 1, position data of the sewing endpoint 71 of the preceding unit pattern of "i" shown in FIG. 12 is acquired.

Next, the CPU 51 determines whether the position data of the sewing endpoint exists within the region defined by the closed region data of the target unit pattern (S17). This determination in S17 is made on the basis of the closed region data of the target unit pattern acquired and stored in the target closed region data storage area 536 in S15 and the position data of the sewing endpoint of the preceding unit pattern acquired and stored in the sewing endpoint storage area 537 in S16. Specifically, this determination is made on whether the position data of this sewing endpoint is present in any of one or a plurality of sewing regions enclosed by the four points stored as the closed region data of this target unit pattern. This processing in S17 determines whether this sewing endpoint is present in the sewing region of this target unit pattern. In Example 1, as shown in FIG. 12, the sewing endpoint 71 is present in the sewing region b21 among those sewing regions b21, b22, b23, b24, and b25 each of which is enclosed by the four points included in the closed region data of the target unit pattern of "l". Therefore, it is determined in S17 that the position data of the sewing endpoint is present in the closed region data of the target unit pattern (YES at S17). Subsequently, it is determined that a thread-cutting operation is not to be performed at a sewing endpoint of the preceding unit pattern of "i" and this setting is stored in the thread-cutting setting storage area 535 (S18). In sewing, a portion between the sewing endpoint 71 of the preceding unit pattern of "i", at which thread-cutting is not to be performed, and the sewing starting point 72 of the target unit pattern is sewn by means of well-known running stitch sewing or one-stitch-sewing along the line segment 73 shown in FIG. 12. A resultant sewing trace is masked when the sewing region b21 of the target unit pattern of "l" is sewn.

Subsequently, to process a target unit pattern that is next in the sewing order and the corresponding preceding unit pattern, the CPU 51 returns to S12 to repeat the processing. For Example 1, when the value of k takes on 5 at S12 as a result of repetition of the processing, a target unit pattern that is fifth in the sewing order is not stored in the sewing target storage area 531, and thus the CPU 51 determines that there is no target unit pattern (NO at S13), to end the thread-cutting determination shown in FIG. 10. Then, the CPU 51 returns to the main flowchart shown in FIG. 9, to end the main processing of the embroidery data creation.

On the other hand, if having determined in S17 that the position data of the sewing endpoint is not present within the area defined by the closed region data of the target unit pattern (NO at S17), the CPU 51 determines that thread-cutting operation is to be performed or to be withheld at the sewing endpoint of the preceding unit pattern and stores this setting in the thread-cutting setting storage area 535 (S19). Then, to process a target unit pattern that is next in the sewing order and the corresponding preceding unit pattern, the CPU 51 returns to S12 to repeat the processing. If having determined in S13 that there is no target unit pattern (NO at S13), the CPU 51 ends the thread-cutting determination shown in FIG. 10 and returns to the main flowchart shown in FIG. 9 to end the main processing of the embroidery data creation.

It is to be noted that whether thread-cutting operation is set to be performed or to be withheld in S19 is determined based on information stored in the detailed thread-cutting setting storage area 538 in the RAM 53. It may be determined beforehand and stored in the detailed thread-cutting setting storage area 538 in the RAM 53. Alternatively, it may be set by the operator each time embroidery data is created and stored in the detailed thread-cutting setting storage area 538 in the RAM 53.

As described above, in thread-cutting setting by the first embodiment, whether a sewing endpoint of a preceding unit pattern is present in a sewing region of a target unit pattern is determined by referring to closed region data of the target unit pattern and position data of the sewing endpoint of the preceding unit pattern. If, as a result, the sewing endpoint of the preceding unit pattern is determined to be present in the sewing region of the target unit pattern, the CPU 51 determines thread-cutting operation at this sewing endpoint not to be performed. On the other hand, if the sewing endpoint of the preceding unit pattern is not present in the sewing region of the target unit pattern, the CPU 51 determines thread-cutting operation at this sewing endpoint to be performed or withheld.

Figure 13:
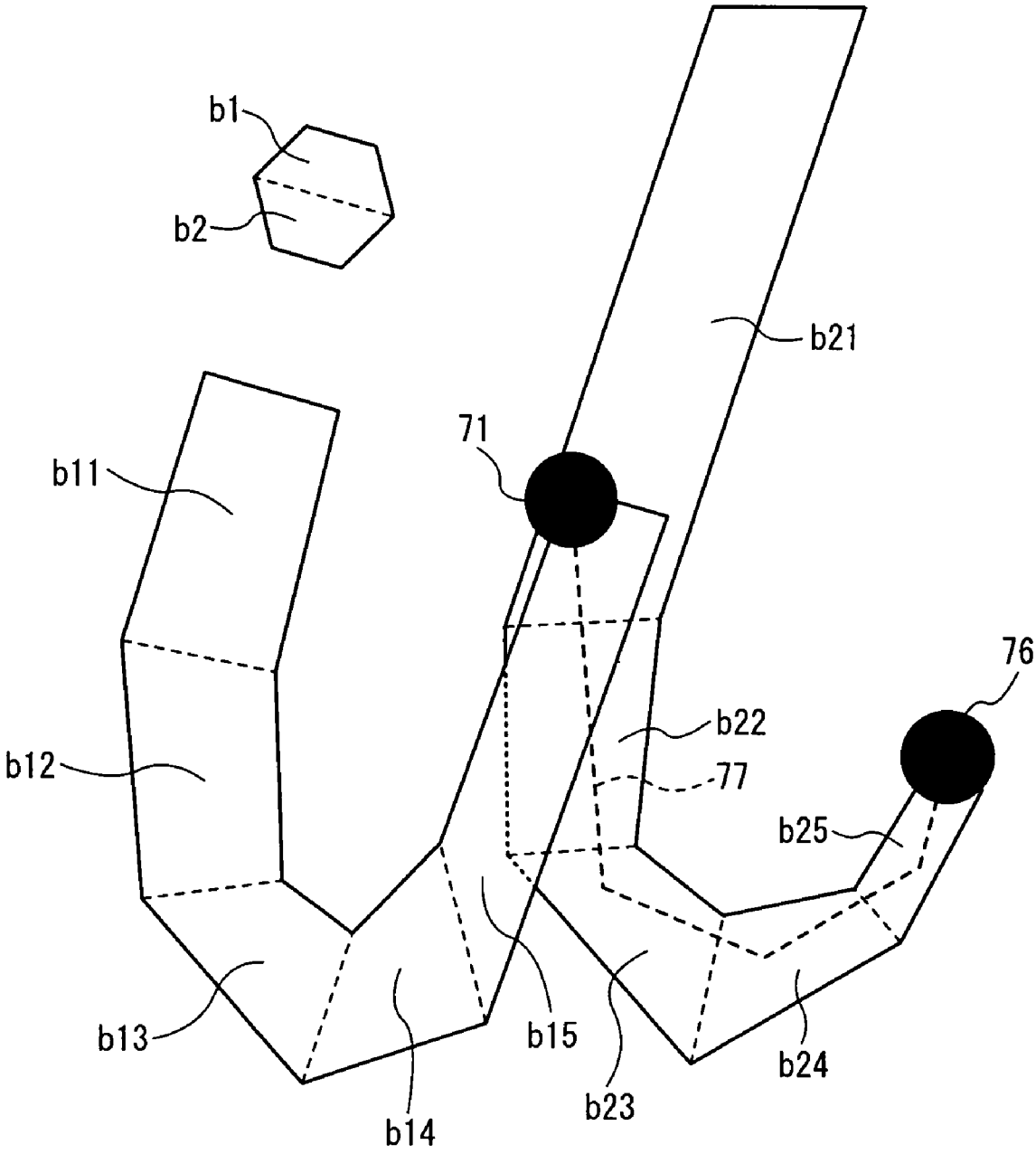
FIG. 13 is another explanatory illustration of sewing regions represented by closed region data of several unit patterns, which constitute a part of Example 1.

Even when a line segment interconnecting the sewing endpoint of the preceding unit pattern and the sewing starting point of the target unit pattern has been sewn by means of well-known running-stitch sewing or one-stitch-sewing since the sewing endpoint of the preceding unit pattern being present in the closed region data of the target unit pattern, there are some cases where this line segment may not completely be included in the area defined by the closed region data of the target unit pattern. In such a case, it is expected that an embroidery finish may be affected. For example, in Example 1 shown in FIG. 13, a sewing starting point of the target unit pattern of "l" is a point 76, while the sewing endpoint 71 of the preceding unit pattern of "i" is present in the closed region data of the target unit pattern of "l". In the case of interconnecting with a line the sewing endpoint 71 of the preceding unit pattern of "i" and the sewing starting point 76 of the target unit pattern of "l", this line is not completely included in the area defined by the closed region data of the target unit pattern. In such a case, for example, one or more stitch points may be defined on the above-described subordinate sides, and a portion between the sewing endpoint of the preceding unit pattern and the sewing starting point of the target unit pattern can be sewn by well-known running-stitch sewing via these connecting points. It is thus possible to completely contain a sewing trace interconnecting the sewing endpoint of the preceding unit pattern and the sewing starting point of the target unit pattern within the area defined by the closed region data of the target unit pattern. In Example 1 shown in FIG. 13, stitch points are defined in the sewing regions of b21, b22, b23, b24, and b25 of the target unit pattern of "l". Accordingly, the sewing trace between the sewing endpoint 71 of the preceding unit pattern and the sewing starting point 76 of the target unit pattern will be made as a running-stitch sewing line 77.

The above-described thread-cutting determination of the first embodiment enables rapid and accurate setting of thread-cutting operation at a sewing endpoint of each unit pattern by using closed region data, to reduce the number of times of thread-cutting between the unit patterns without affecting a finish of embroidery (alternatively referred to as a "result of embroidery"). Further, labor can be mitigated in dealing with snips of thread at a stage of embroidery, thereby reducing sewing time. Furthermore, in the first embodiment, it is not necessary to create or modify information required to determine thread-cutting setting for each of character attributes, to rapidly accommodate addition and modification of the character attributes.

The above first embodiment has assumed that as in the case of alphabetic characters in italics, a sewing endpoint of a preceding unit pattern has been present in a sewing region of a target unit pattern and also assumed a unit pattern of a small number of strokes. This method has an advantage that it is unnecessary to divide cases based on a configuration of unit patterns. On the other hand, in the case of sewing a character having a large number of strokes as in the case of Chinese characters, if a portion between a sewing endpoint of a preceding unit pattern and a sewing starting point of a target unit pattern are sewn without cutting a thread, an unintended jump stitch may exist to adversely affect an embroidery finish. As used herein, a "jump stitch" refers to a stitch that goes from one portion of the design to another or from one design to another design. To solve this problem, the thread-cutting determination processing in S5 of FIG. 9 may be performed as described in second and third embodiments described below. The following will describe a processing procedure of creating embroidery data in Examples 2-5 shown in FIGS. 22-29 by using an embroidery data creation apparatus of the second and third embodiments, with reference to the drawings. Description of a physical and an electrical configuration of the embroidery data creation apparatus of the second and third embodiments will be omitted because they are the same as those of the first embodiment. Further, as in the case of the first embodiment, the embroidery data creation apparatus 41 will be described as provided separately from the embroidery sewing machine.

First, an example is described in which Chinese characters of Examples 2-5 respectively shown in FIGS. 22-25 are embroidered in hold Gothic script. Example 2 in FIG. 22 comprises two Chinese characters pronounced as "iri" and "guchi" respectively. Example 3 in FIG. 23 comprises two Chinese characters pronounced as "iri" and "kawa" respectively. Example 4 in FIG. 24 comprises two Chinese characters pronounced as "iri" and "e" respectively. Example 5 in FIG. 25 comprises two Chinese characters pronounced as "iri" and "chi" respectively. That is, Examples 2-5 have a common unit pattern ("iri" in Chinese character) that is first in sewing order. It is supposed that the characters are sewn from the leftmost one toward the right ones sequentially in Examples 2-5. Further, FIGS. 26-29 are explanatory illustrations of sewing regions represented by closed region data of Chinese characters of Examples 2-5 respectively. Each of the unit patterns of Examples 2-5 is comprised of one Chinese character and, further, composed of partial patterns as many as the number of strokes of the Chinese character. Those partial patterns are sewn in accordance with writing order of the unit pattern (Chinese character). For example, the Chinese character "iri", which is the first unit pattern of Example 2 of FIG. 26, has two strokes and is thus composed of two partial patterns of B11 and B12. Further, "iri" is sewn in order of B11 and B12 in accordance with the writing order of this Chinese character. As is clear from FIGS. 26-29, a sewing endpoint 78 of the first unit pattern ("iri" of the Chinese character) of each of Examples 2-5 is present in the sewing region of the unit pattern (Chinese character) that is second in sewing order.

Figure 14:
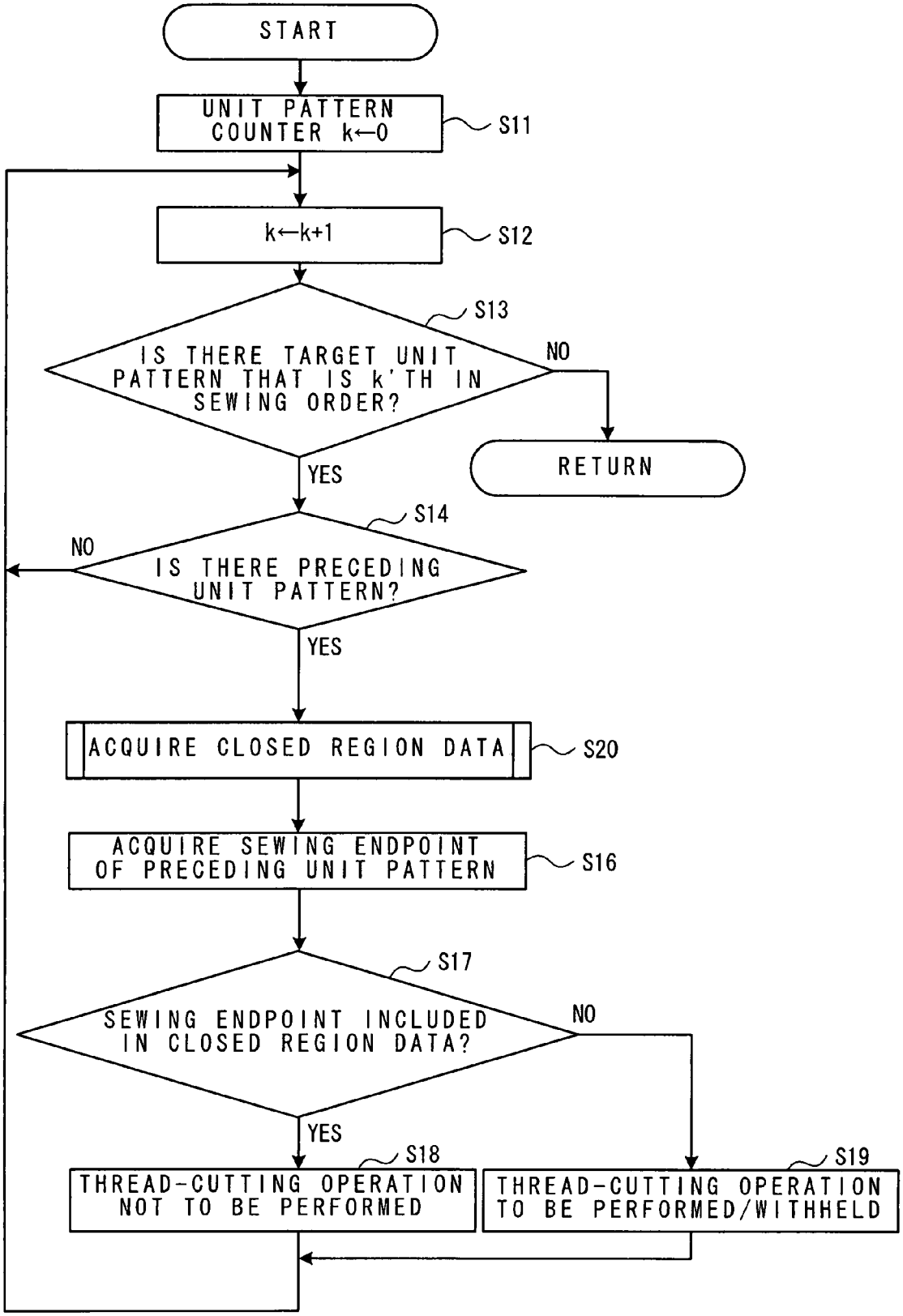
FIG. 14 is a flowchart showing a flow of setting of thread-cutting operations.
Figure 15:
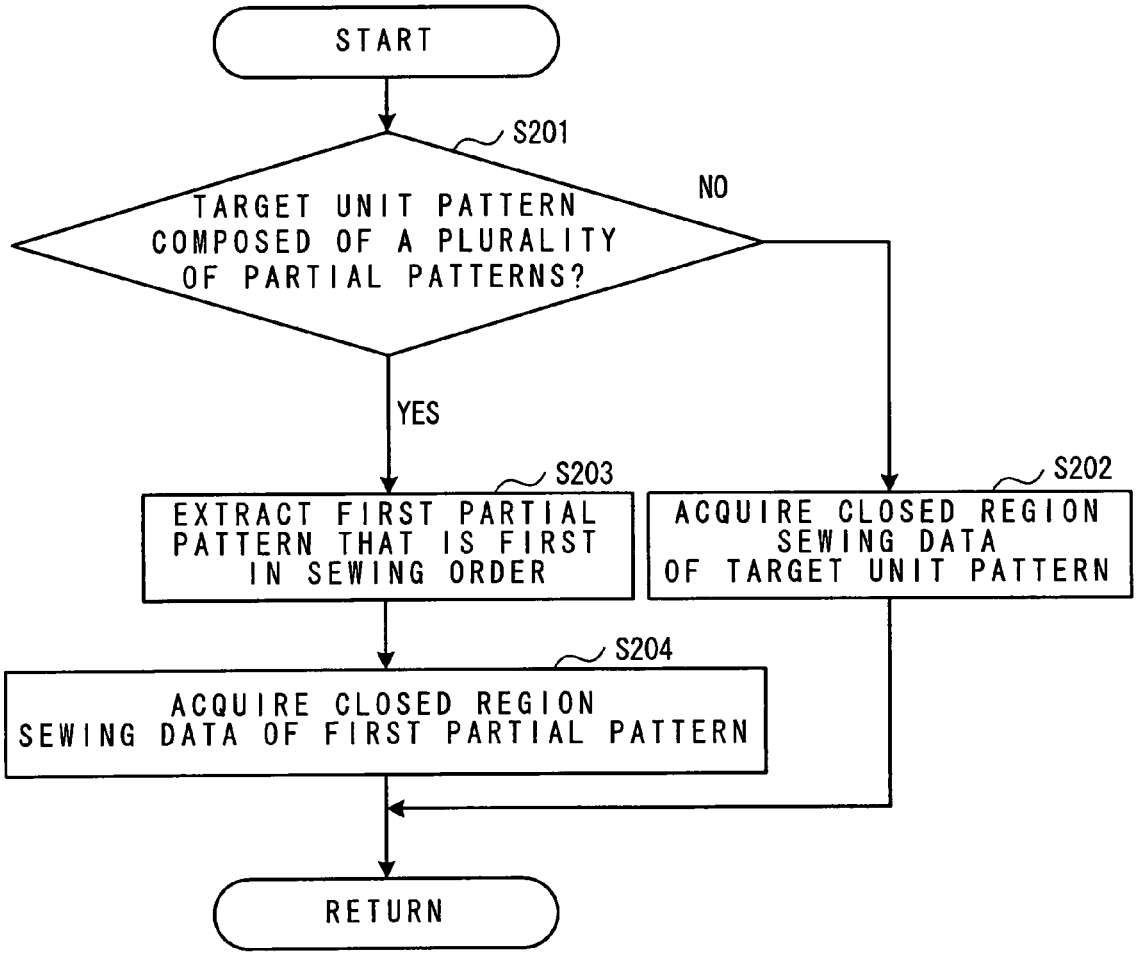
FIG. 15 is a sub-flowchart showing a flow of acquiring closed region data.

It is here supposed that in Example 2 shown in FIG. 22, the unit pattern that is second in the sewing order ("guchi" in Chinese character) is a target unit pattern and the unit pattern that is first in the sewing order ("iri" in Chinese character) is a preceding unit pattern (k=2 in S12). In this case, it will be described below with reference to FIGS. 14 and 15 how the thread-cutting operation is determined in S5 of FIG. 9 by the embroidery data creation apparatus 41 of the second embodiment. As shown in FIG. 14, a flow of the thread-cutting determination in the second embodiment is different in S20 from that of the first embodiment. The following will describe the different processing in S20 with reference to FIG. 15, while description of processing common to the first and second embodiments are omitted. The program that performs the thread-cutting determination shown in FIGS. 14 and 15 is stored beforehand in the embroidery data creation program storage area 525 in the ROM 52 and executed by the CPU 51.

Figure 26:
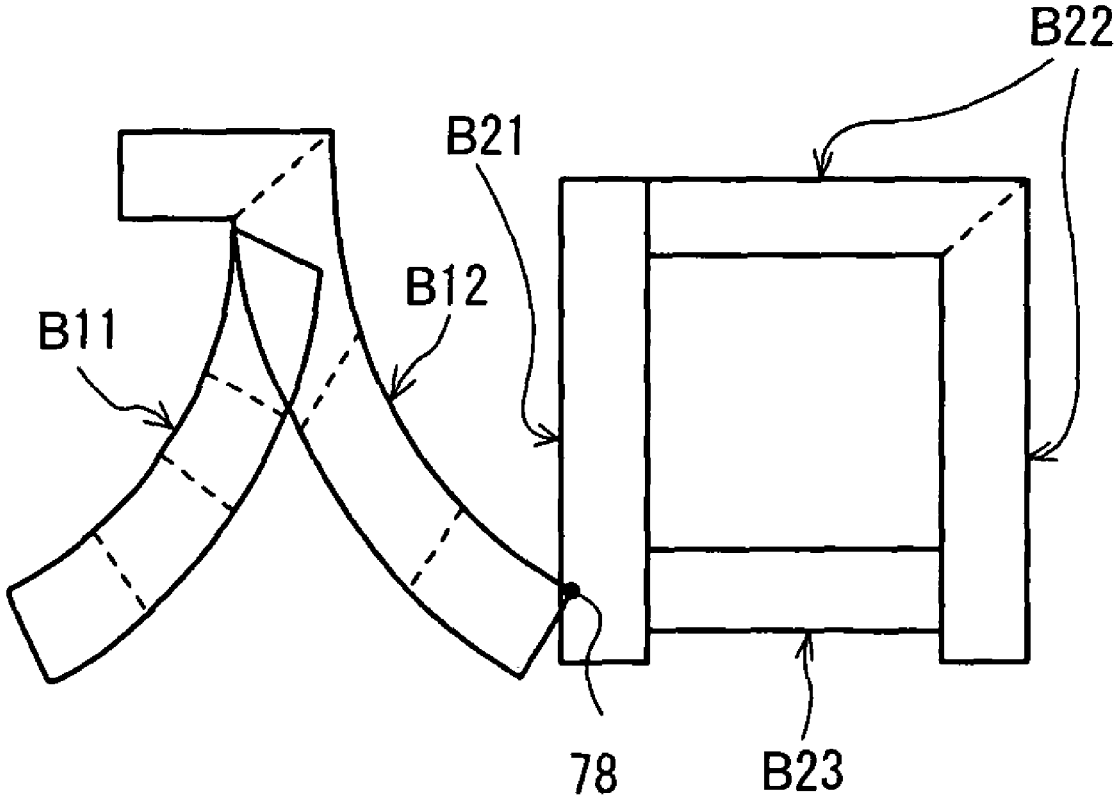
FIG. 26 is an explanatory illustration of sewing regions represented by closed region data of several unit patterns, which constitute Example 2.

In the second embodiment, if a target unit pattern is composed of a plurality of partial patterns, determination is made by referring to closed region data of the first partial pattern which is first in sewing order out of the plurality of partial patterns. Therefore, first in S201, the CPU 51 refers to a closed region data storage area 532 and a sewing order storage area 534 in order to determine whether a target unit pattern which is k'th in sewing order is composed of a plurality of partial patterns having different sewing starting points. In Example 2, as shown in FIG. 26, Chinese character "guchi", which is a target unit pattern, is composed of three partial patterns of B21, B22 and B23 as many as the number of strokes of this character, and thus it is determined to be composed of a plurality of partial patterns (YES at S201). Subsequently, the CPU 51 refers to the closed region data storage area 532 and a sewing order storage area 534 in order to extract a first partial pattern which is first in the sewing order from among these partial patterns (S203). In Example 2, the partial patterns are sewn in accordance with the stroke order (B21≦B22≦B23); therefore the partial pattern B21 is extracted (S203). Subsequently, the CPU 51 acquires closed region data of this first partial pattern B21 out of closed region data pieces stored in the closed region data storage area 532 (S204) and stores it in a target closed region data storage area 536 in a RAM 53. This closed region data is referred to in S17 in the flowchart shown in FIG. 14. Then, the CPU 51 returns to the flowchart of thread-cutting determination shown in FIG. 14 and proceeds to S16.

On the other hand, if the CPU 51 determines that the target unit pattern is not composed of a plurality of partial patterns (NO at S201), the CPU 51 acquires closed region data of the target unit pattern out of the closed region data pieces stored in the closed region data storage area 532 (S202) and stores it in the target closed region data storage area 536 in the RAM 53. Then, the CPU 51 returns to the flowchart of the thread-cutting determination shown in FIG. 14 and proceeds to S16.

As described above, different processing from that of the first embodiment is performed in S20 of FIG. 14. Then, if a target unit pattern is composed of a plurality of partial patterns, the CPU 51 determines in S17 whether a sewing endpoint of the preceding unit pattern is present in the sewing region represented by the closed region data of the first partial pattern acquired in S20. On the other hand, if the target unit pattern is not composed of a plurality of partial patterns, the CPU 51 refers to in S17 the closed region data of the target unit pattern acquired in S20, in order to determine whether the sewing endpoint of the preceding unit pattern is present in a sewing region of the target unit pattern.

Figure 27:
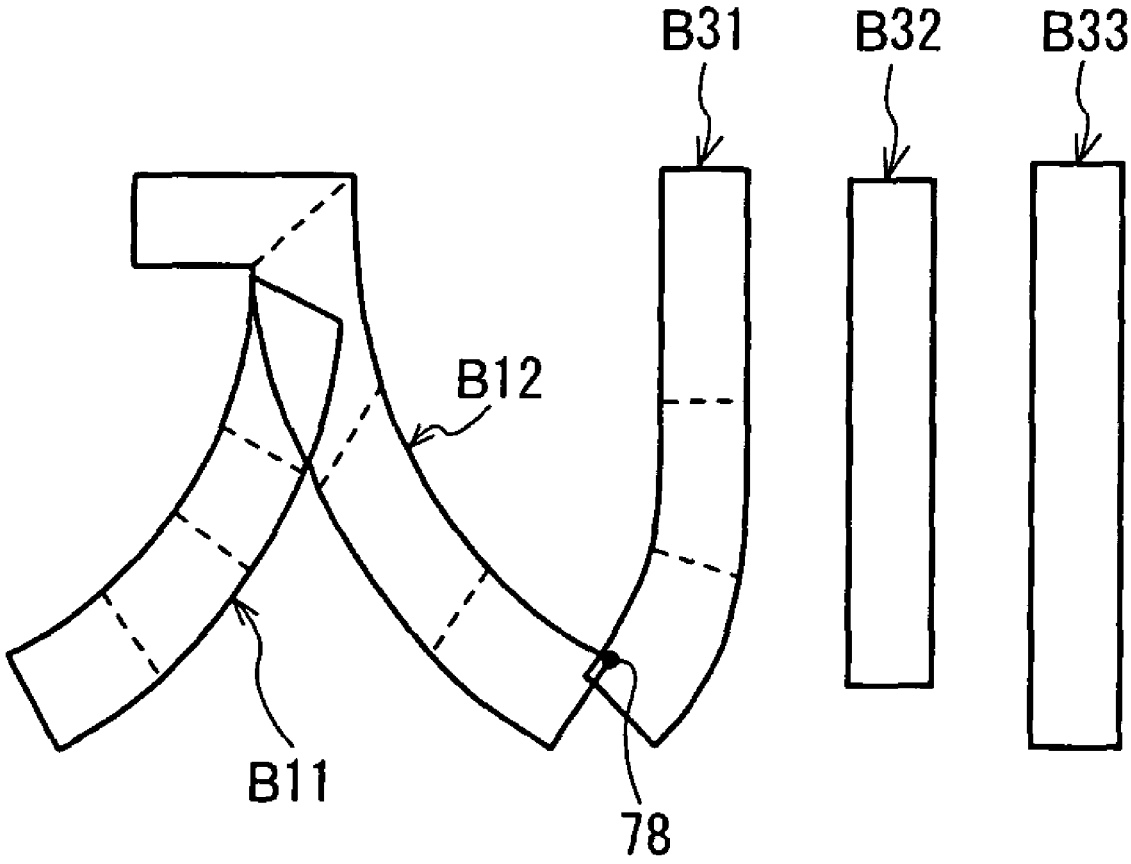
FIG. 27 is an explanatory illustration of sewing regions represented by closed region data of several unit patterns, which constitute Example 3.
Figure 28:
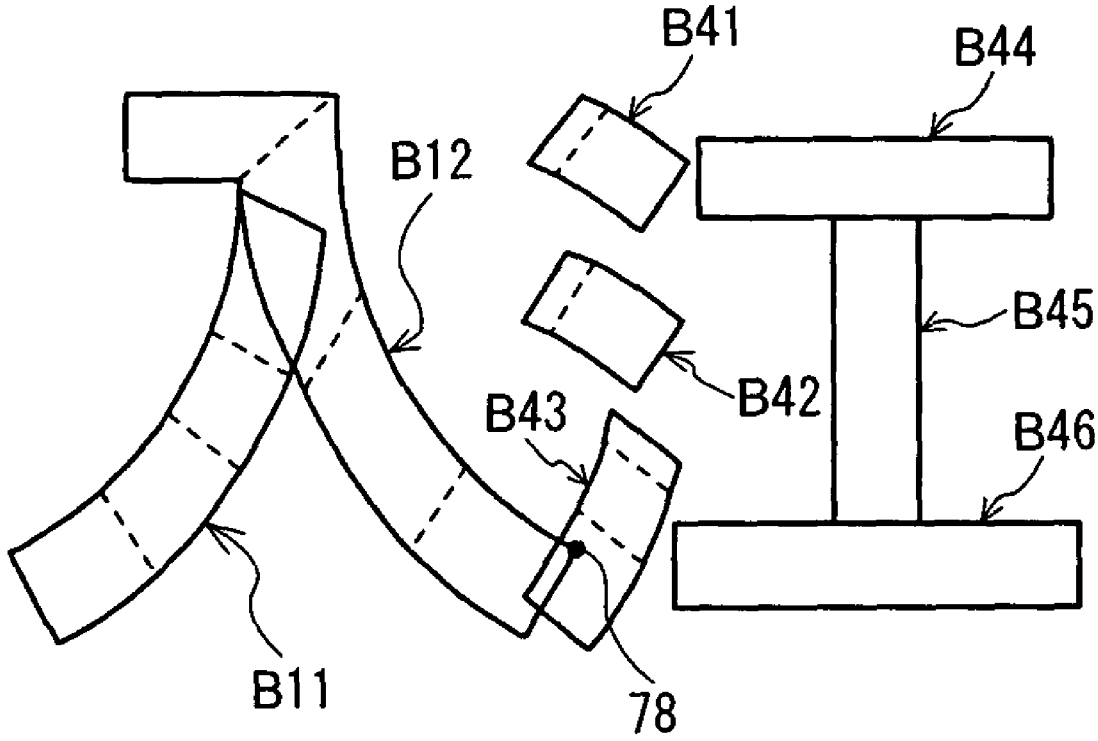
FIG. 28 is an explanatory illustration of sewing regions represented by closed region data of several unit patterns, which constitute Example 4.

Similarly, in Example 3 shown in FIG. 27, the CPU 51 refers to closed region data of a first partial pattern B31 out of partial patterns B31, B32, and B33 of Chinese character "kawa", which is a target unit pattern, and determines thread-cutting operation not to be performed. In Example 4 shown n FIG. 28, the CPU 51 refers to closed region data of a first partial pattern B41 out of partial patterns B41, B42, B43, B44, B45, and B46 of Chinese character "e", which is a target unit pattern, and determines thread-cutting operation to be performed or withheld. In Example 5 shown in FIG. 29, the CPU 51 refers to closed region data of a first partial pattern B51 out of partial patterns B51, B52, B53, B54, B55, and B56 of Chinese character "chi", which is a target unit pattern, and determines thread-cutting operation to be performed or withheld.

In all of the above Examples 2-5, the sewing endpoint 78 of Chinese character "iri", which is the first unit pattern, is present in a sewing region of the unit pattern that is second in sewing order. Thus, according to the first embodiment, it is determined that thread-cutting operation is not to be performed at the sewing endpoint 78. However, if a portion between a sewing endpoint of a preceding unit pattern and a sewing starting point of a target unit pattern is sewn without changing sewing order of partial patterns corresponding to the number of strokes of the character, in Examples 4 and 5, an unintended jump stitch exists between the unit patterns. According to the second embodiment, in Examples 2 and 3, similar to the first embodiment, CPU 51 determines thread-cutting operation not to be performed, but in Examples 4 and 5, determines thread-cutting operation to be performed or withheld, so that unintended jump stitch can be avoided. Further, in the first embodiment, position data of a sewing endpoint of a preceding unit pattern and closed region data of a target unit pattern is referred to in S17 in FIG. 10. However, according to the present embodiment, in all of Examples 2-5, only closed region data of the first partial pattern that constitutes a part of the target unit pattern can be referred to in S17 in FIG. 14.

According to the second embodiment described above, closed region data of the first partial pattern that is first in the sewing order is used, so that it can be determined whether or not thread-cutting operation is to be performed, considering the sewing order of the partial patterns. Further, CPU 51 needs to refer only to the closed region data of the first partial pattern, so that it is possible to rapidly determine whether thread-cutting operation is to be made as compared to the case of referring to all of the closed region data of the target unit pattern.

Figure 16:
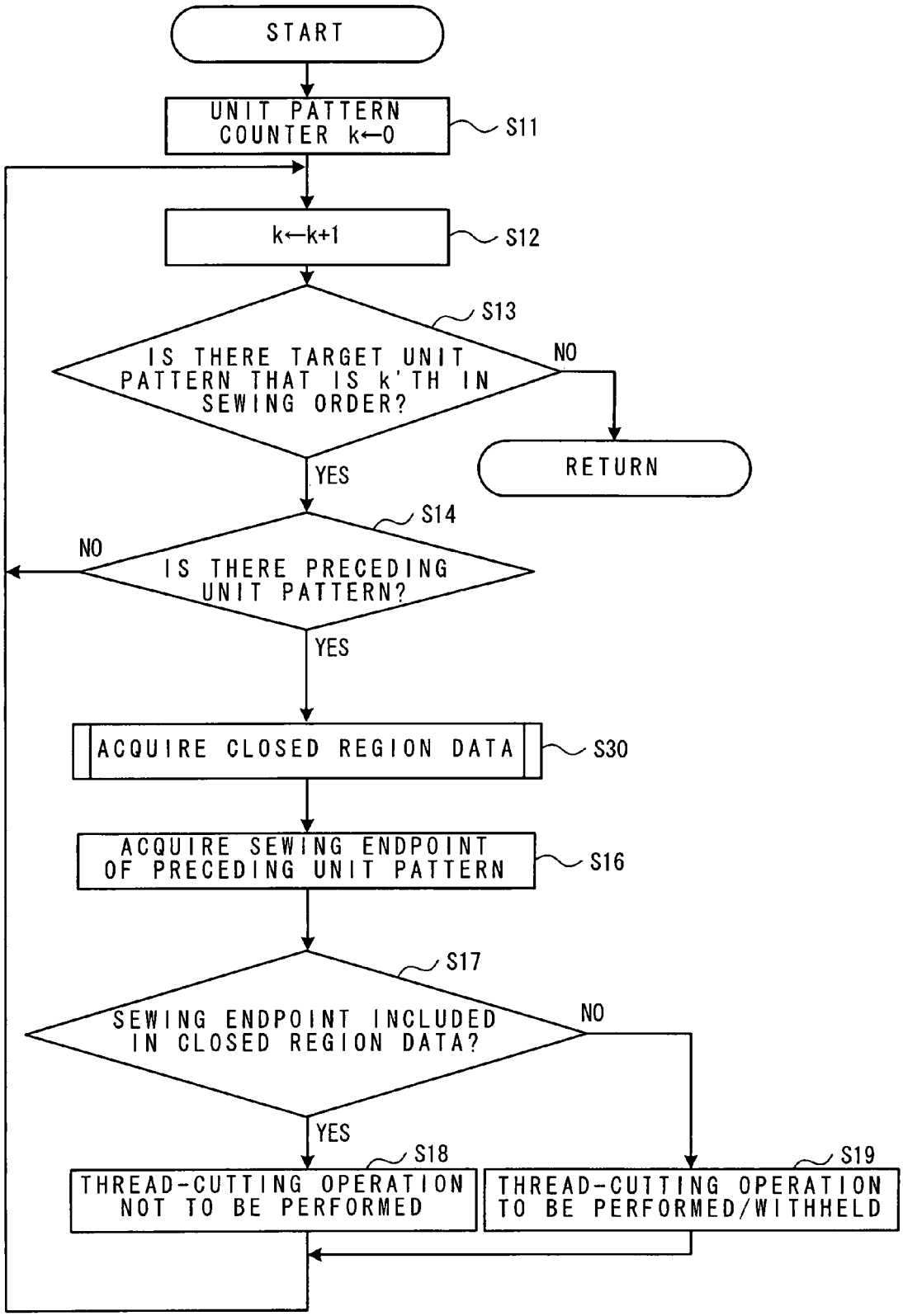
FIG. 16 is a flowchart showing a flow of setting of thread-cutting operations.
Figure 17:
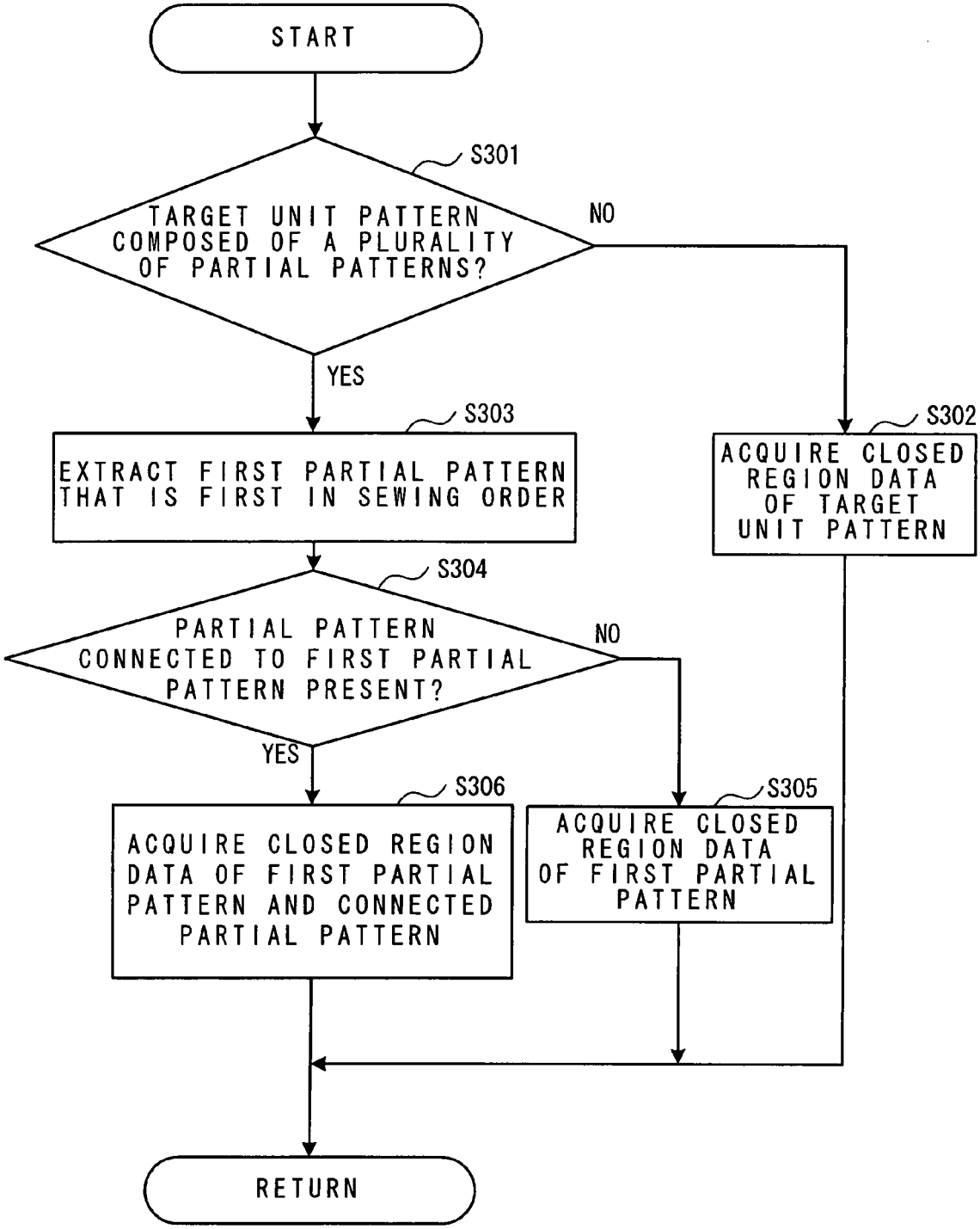
FIG. 17 is a sub-flowchart showing the flow of acquiring closed region data.

Next, in Example 2 shown in FIG. 22, it is assumed that the unit pattern that is second in sewing order ("guchi" in Chinese character) is a target unit pattern and the unit pattern that is first in sewing order ("iri" in Chinese character) is a preceding unit pattern (k=2 at S12). In this case, it will be described below with reference to FIGS. 16 and 17 how the settings of thread-cutting are determined in S5 in FIG. 9 by the embroidery data creation apparatus 41 of a third embodiment. As shown in FIG. 16, a flow of the thread-cutting determination in the third embodiment is different from that of the first embodiment in S30. The following will describe the different processing in S30 with reference to FIG. 17, while description of processing common to the first and third embodiments will be omitted. The program that performs the thread-cutting determination shown in FIGS. 16 and 17 is stored beforehand in the embroidery data creation program storage area 525 in the ROM 52 and executed by the CPU 51 shown in FIG. 6.

In the third embodiment, if a first partial pattern, which is first in the sewing order, out of a plurality of partial patterns of a target unit pattern has a partial pattern connected to it, the determination is made by referring to closed region data of each of this first partial pattern and the connected partial pattern. Therefore, in S301, a CPU 51 refers to a closed region data storage area 532 and a sewing order storage area 534 in order to determine whether a target unit pattern which is k'th in the sewing order is composed of a plurality of partial patterns having different sewing starting points. If the target unit pattern is not composed of a plurality of partial patterns (NO at S301), the CPU 51 acquires closed region data of the target unit pattern out of the closed region data pieces stored in the closed region data storage area 532 (S302) and stores it in a target closed region data storage area 536 in a RAM 53. This closed region data is referred to in S17 of a flowchart shown in FIG. 16. Then, the CPU 51 returns to the flowchart shown in FIG. 16 and proceeds to S16.

In Example 2, as shown in FIG. 26, the Chinese character "guchi", which is a target unit pattern, is composed of three partial patterns of B21, B22 and B23, and thus, it is determined to be composed of a plurality of partial patterns (YES at S301). Subsequently, the CPU 51 refers to the closed region data storage area 532 and a sewing order storage area 534 in order to extract a first partial pattern which is first in the sewing order from among these partial patterns (S303). In Example 2, the partial patterns are sewn in accordance with the stroke order (B21→B22→B23). Therefore, the partial pattern B21 is extracted (S303). Subsequently, the CPU 51 refers to the closed region data storage area 532 in order to determine whether there is a connected partial pattern, which is a partial pattern connected to the first partial pattern (S304). It is to be noted that a "connected partial pattern" includes not only a partial pattern which has a portion directly connected to the first partial pattern, but also a partial pattern which has a portion connected to another partial pattern which is further connected to the first partial pattern. In S304, the CPU 51 compares a sewing region enclosed by four points included in the closed region data of the first partial pattern and a sewing region enclosed by four points included in the closed region data of any partial pattern other than the first partial pattern out of those of the target unit pattern, both of which stored in the closed region data storage area 532. Subsequently, CPU 51 determines whether the sewing regions are connected to each other.

If it is determined in S304 that there is no connected partial pattern (NO at S304), the CPU 51 acquires closed region data of the first partial pattern of the target unit pattern out of the closed region data pieces stored in the closed region data storage area 532 (S305). And, it is stored in a target unit pattern closed region data storage area 536 in the RAM 53 as data to be referred to in S117 of the flowchart shown in FIG. 16. Then, the CPU 51 returns to the flowchart shown in FIG. 16, and proceeds to S116. If there is no connected partial pattern (NO at S304), the closed region data of the first partial pattern of the target unit pattern is acquired (S305), in order to determine whether thread-cutting operation is to be performed, considering sewing order of the partial patterns similar to the case of the second embodiment. Alternatively, if there is no connected partial pattern (NO at S304), the closed region data of the target unit pattern may be acquired.

In Example 2, as shown in FIG. 26, the first partial pattern B21 is connected to the patterns B22 and B23. Therefore, the CPU 51 determines that there is a partial pattern connected to the first partial pattern (YES at S304). Subsequently, the CPU 51 acquires the closed region data of the first partial pattern B21 and each of the connected partial patterns B22 and B23 that are connected to the first partial pattern out of the closed region data pieces of the target unit pattern stored in the closed region data storage area 532 (S306) and stores it in the target unit pattern closed region data storage area 536 in the RAM 53. Then, the CPU 51 returns to the flowchart of the thread-cutting determination in FIG. 16 in order to refer to a stitch point data storage area 533 and the sewing order storage area 534, thereby acquiring position data of a sewing endpoint 78 of "iri" in Chinese character, which is a preceding unit pattern (S16).

As described above, in the thread-cutting determination of the third embodiment, processing different from that of the first embodiment is performed in S30. Then, if a target unit pattern is composed of a plurality of partial patterns and there is a partial pattern that is connected to the first partial pattern, in S17 of FIG. 16 the CPU 51 refers to the closed region data of each of the first partial pattern and the connected partial pattern. Based on the closed region data, the CPU 51 determines whether a sewing endpoint of the preceding unit pattern is present in a sewing region of the target unit pattern.

Similarly, in Example 3 shown in FIG. 27, the CPU 51 refers to closed region data of only a first partial pattern B31 out of partial patterns B31, B32, and B33 of Chinese character "kawa", which is a target unit pattern, and determines thread-cutting operation not to be performed. In Example 4 shown in FIG. 28, the CPU 51 refers to closed region data of only a first partial pattern B41 out of partial patterns B41, B42, B43, B44, B45, and B46 of Chinese character "e", which is a target unit pattern, and determines thread-cutting operation to be performed or withheld. In Example 5 shown in FIG. 29, the CPU 51 refers to closed region data of a first partial pattern B51, the partial pattern B52 connected to the first partial pattern B51, and the partial pattern B53 further connected to B52 out of partial patterns B51, B52, B53, B54, B55, and B56 of Chinese character "chi", which is a target unit pattern, to determine thread-cutting operation not to be performed.

Figure 29:
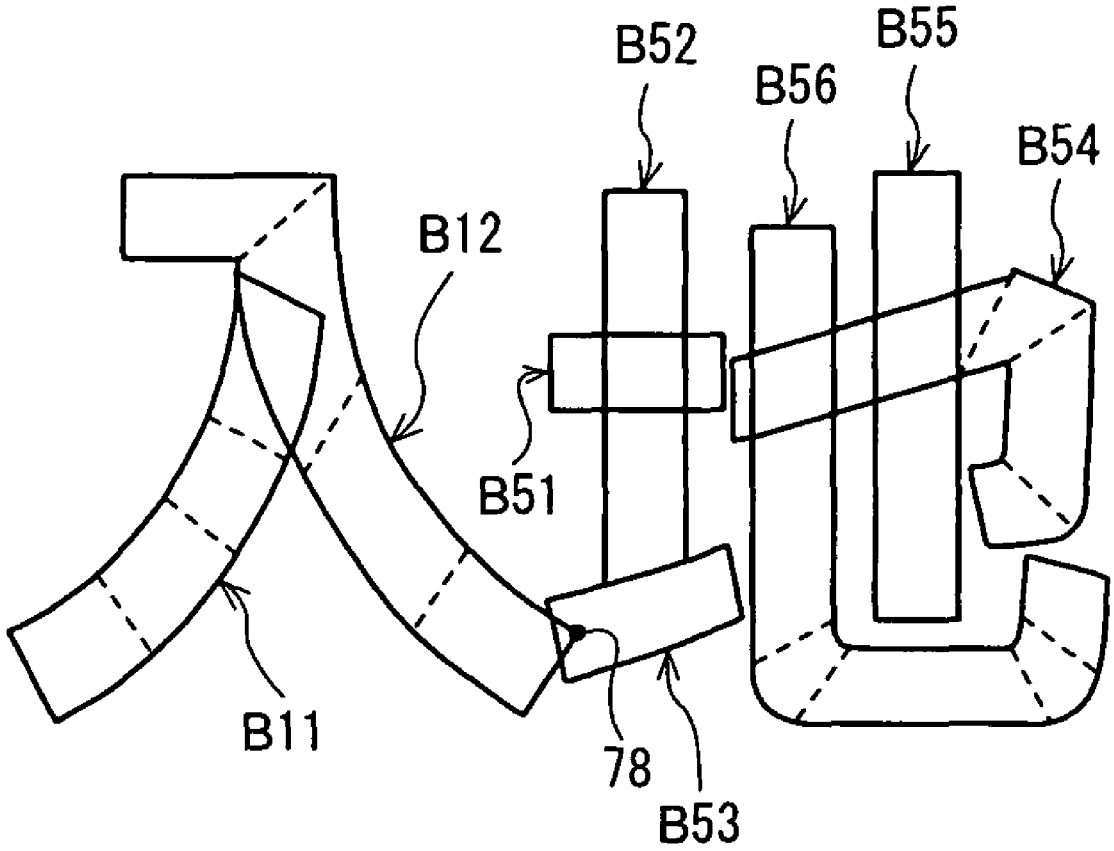
FIG. 29 is an explanatory illustration of sewing regions represented by closed region data of several unit patterns, which constitute Example 5.

In the above Examples 2-5, in comparison between the second and third embodiments in terms of thread-cutting settings, they are different from each other in Example 5 shown in FIG. 29. As shown in FIG. 29, in Example 5, a sewing endpoint 78 of Chinese character "iri", which is the preceding unit pattern, is present in the sewing region B53 of Chinese character "chi" which is a target unit pattern. Since B53 is connected to the sewing region of the first partial pattern B51 via another sewing region of B52, running-stitch sewing points can be defined in the connected sewing regions. Accordingly, even if it is determined that thread-cutting operation is not to be performed at the sewing endpoint, it is possible to perform sewing without changing the sewing order and without causing a jump stitch. According to the third embodiment, in Example 5 where there is a sewing endpoint of a preceding unit pattern in a sewing region connected to the first partial pattern, thread-cutting operation is set not to be performed, so that it is possible to decrease such thread-cutting operation as much as possible.

Further, in the first embodiment, in S17 in FIG. 10, closed region data of a target unit pattern has been referred to. On the other hand, in the third embodiment, all of closed region data pieces of the target unit pattern are referred to in Example 2, whereas in other Examples 3-5, CPU 51 refers only to the closed region data of the first partial pattern and that of its connected partial pattern, that is, only a part of the target unit pattern.

According to the third embodiment described above, thread-cutting determination can be made in such a manner as to decrease thread-cutting operation as much as possible at a sewing endpoint of a preceding unit pattern, without affecting an embroidery finish, considering the sewing order of the partial patterns. Further, CPU 51 only needs to refer to each of the closed region data of the first partial pattern and its connected partial pattern, so that it is possible to rapidly determine whether thread-cutting operation is to be made, as compared to the case of referring to all of the closed region data of the target unit pattern.

The above-described first through third embodiments assume a case where a sewing endpoint of a preceding unit pattern is defined beforehand. This method has an advantage that it is possible to perform thread-cutting determination rapidly by utilizing the sewing endpoint included in the closed region data beforehand. However, this sewing endpoint is not always defined in such a manner as to suppress thread-cutting operation in sewing. Therefore, the following fourth embodiment may be employed. The following will describe a flow of processing in the fourth embodiment with reference to the drawings. It is to be noted that a physical and an electrical configuration of an embroidery data creation apparatus in the fourth embodiment are the same as those of the first embodiment except for storage areas of a RAM. Thus, the different storage areas of the RAM are described below and description of the same configurations as those of the first embodiments will be omitted. Further, similar to the case of the first embodiment, an embroidery data creation apparatus 41 will be described as provided separately from an embroidery sewing machine.

Figure 30:
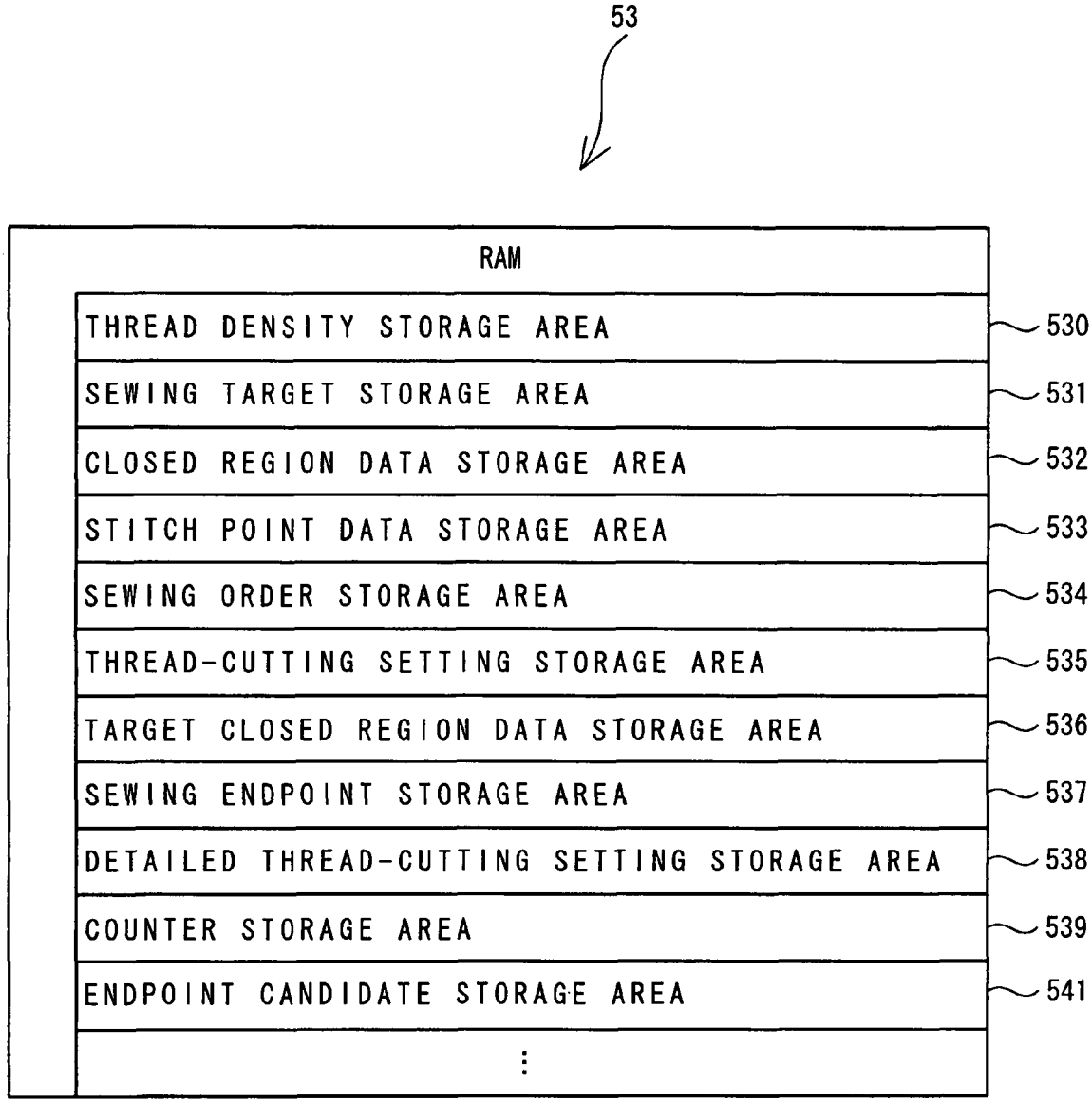
FIG. 30 is an explanatory diagram of storage areas of the RAM.

First, storage areas of a RAM 53 different from those of the first embodiment are described with reference to FIG. 30. As shown in FIG. 30, in addition to the storage areas of the RAM 53 of the first embodiment shown in FIG. 8, there is provided an endpoint candidate storage area 541, which stores: an expected endpoint, which is a candidate of a stitch point that is last in sewing order in a preceding unit pattern; a stitch point which is to be sewn immediately prior to this expected endpoint; and a point along a line segment interconnecting these points.

Figure 18:
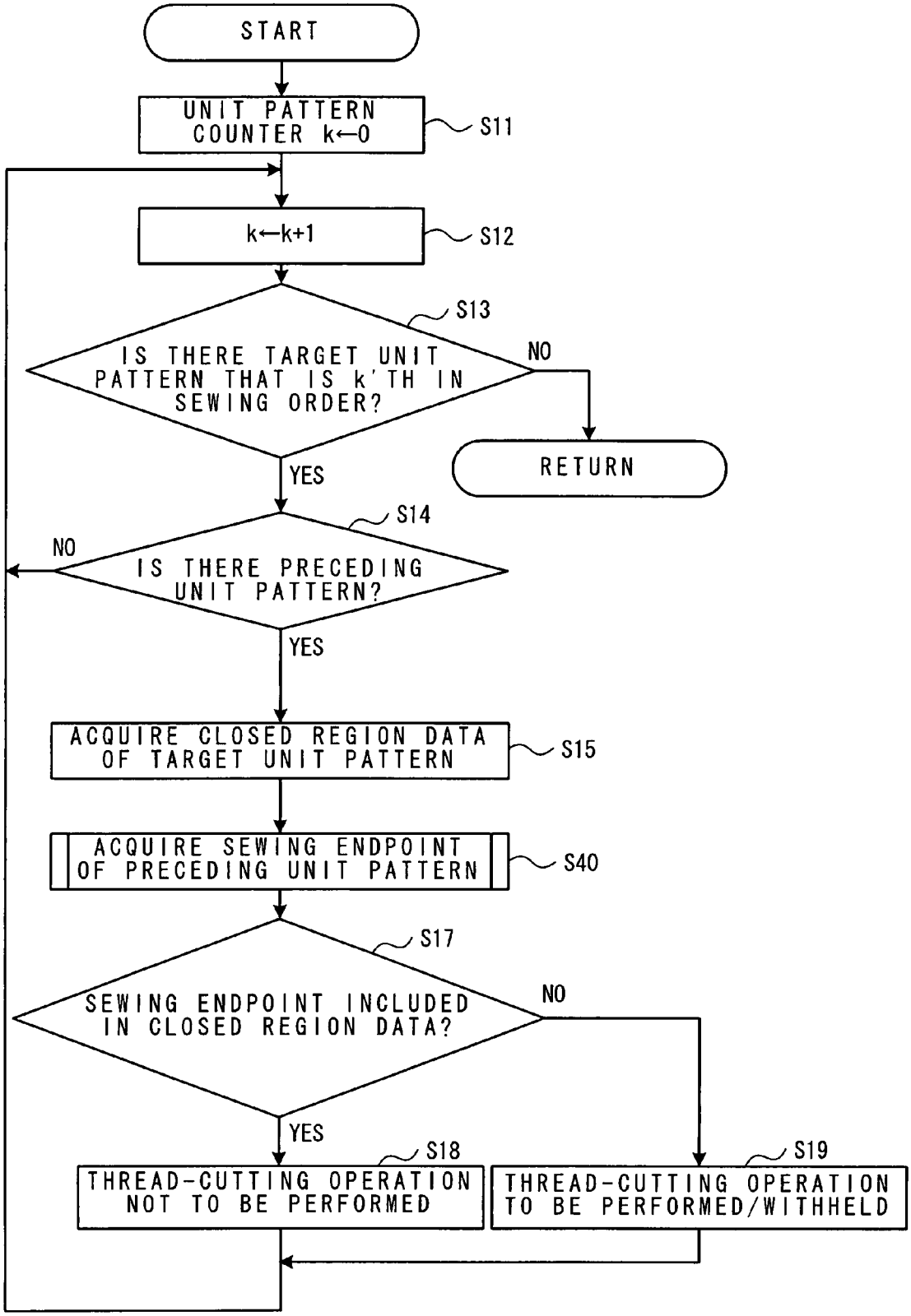
FIG. 18 is a flowchart showing a flow of setting of thread-cutting operations.
Figure 19:
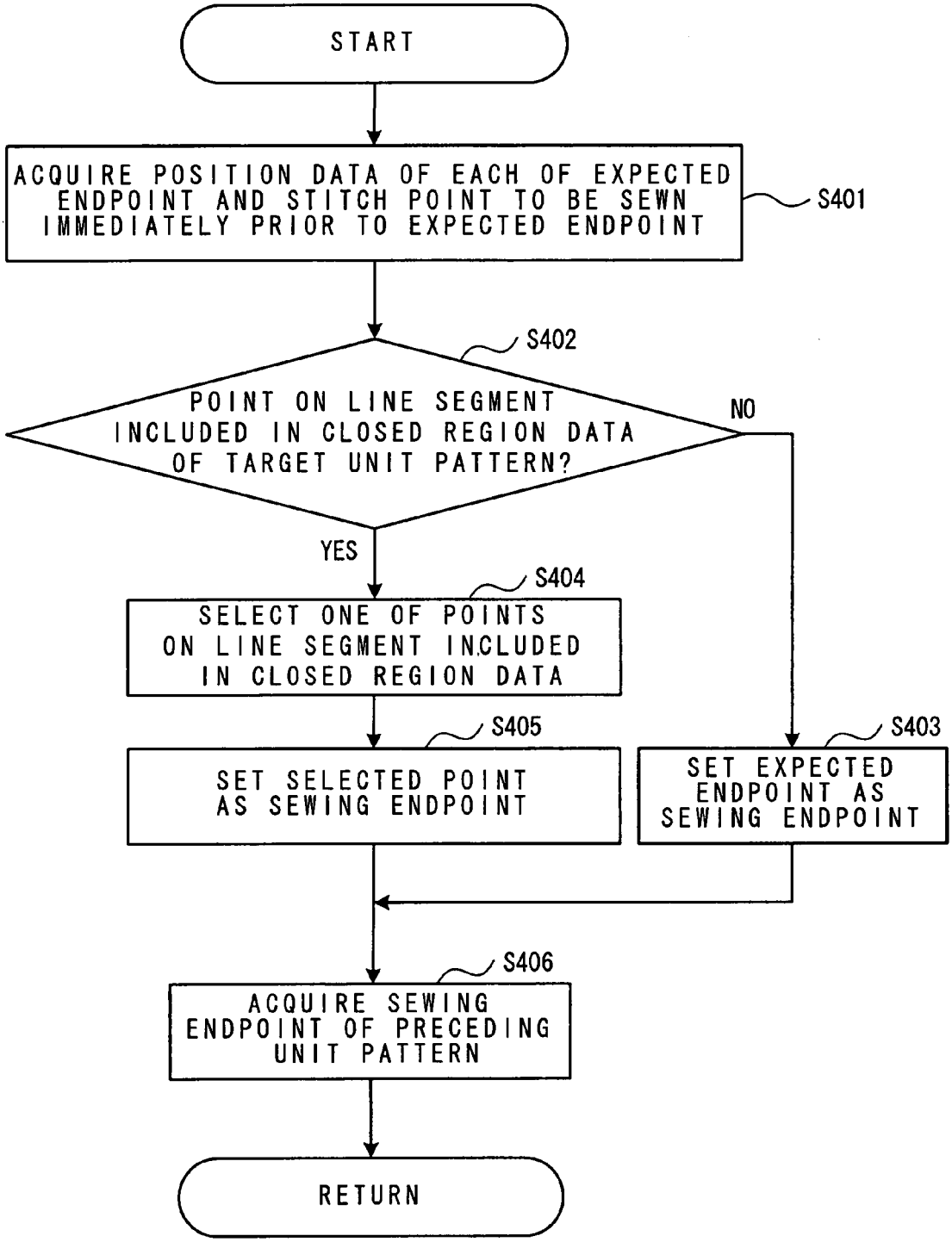
FIG. 19 is a sub-flowchart showing the flow of acquiring a sewing endpoint of a preceding unit pattern.

The following will describe a flow of thread-cutting determination (S5 of FIG. 9) in the fourth embodiment with reference to FIGS. 18 and 19. As shown in FIG. 18, the flow of thread-cutting determination in the fourth embodiment is different from that of the first embodiment in processing in S40. The following will describe the different processing in S40 from the first embodiment with reference to FIG. 19, while description of processing common to the first and fourth embodiments will be omitted. The program that performs the thread-cutting determination shown in FIGS. 18 and 19 is stored beforehand in an embroidery data creation program storage area 525 in a ROM 52 and executed by a CPU 51 shown in FIG. 6.

In the fourth embodiment, an expected endpoint, which is a candidate of a stitch point that is last in sewing order in a preceding unit pattern, and a stitch point which is to be sewn immediately prior to this expected endpoint are connected to each other by a line segment. Based on whether any one of the points on this line segment is included in closed region data of a target unit pattern, a sewing endpoint of the preceding unit pattern is defined. To do so, in S401, the CPU 51 refers to the stitch point data storage area 533 and the sewing order storage area 534, and acquires position data of an expected endpoint, which is a candidate of a stitch point that is last in sewing order in a preceding unit pattern, and that of a stitch point which is to be sewn immediately prior to this expected endpoint. These acquired position data pieces are stored in an endpoint candidate storage area 541 in the RAM 53. At this point of time, an intra-sewing region flag for each point is stored as being OFF.

Subsequently, the CPU 51 determines whether position data of an arbitrary point on a line segment interconnecting the expected endpoint and the stitch point to be sewn immediately prior to this expected endpoint, both of which are stored in the endpoint candidate storage area 541, is included in the area defined by the closed region data of the target unit pattern acquired in S15 of FIG. 18 (S402). For the point on this line segment which is determined to be included in the closed region data of the target unit pattern, the intra-sewing region flag is made ON and stored in the endpoint candidate storage area 541. If the intra-sewing region flag has not been set ON for the position data of any point on the line segment, the CPU 51 decides that the position data is not included in the closed region data (NO at S402). In this case, the CPU 51 sets the expected endpoint stored in the endpoint candidate storage area 541 as a sewing endpoint (S403), to store position data of this sewing endpoint and its sewing order in the stitch point data storage area 533 and the sewing order storage area 534 respectively. Then, position data of the sewing endpoint set in S403 is stored in a sewing endpoint storage area 537 (S406). Subsequently, the CPU 51 returns to a flowchart shown in FIG. 18, to proceed to S17.

On the other hand, if the intra-sewing region flag has been set ON for any point on the line segment interconnecting the expected endpoint and the stitch point to be sewn immediately prior to this expected endpoint, the CPU 51 determines that the position data is included in the closed region data (YES at S402). Subsequently, the CPU 51 selects one of the points on the line segment whose intra-sewing region flag is ON (S404). A method of selecting will be described later. Then, the CPU 51 sets this selected point on the line segment as a sewing endpoint (S405) and stores position data of this sewing endpoint and its sewing order in the stitch point data storage area 533 and the sewing order storage area 534 respectively. Subsequently, the CPU 51 stores the position data of the sewing endpoint set in S405 in the sewing endpoint storage area 537 (S406) and returns to the flowchart shown in FIG. 18, to proceed to S17.

It is to be noted that an arbitrary method can be employed for selecting a point on the line segment in S404. For example, it may be possible to select a point that is closest to either the expected endpoint or the stitch point to be sewn immediately prior to this expected endpoint. Alternatively, it may be possible to select a midpoint from among points on the line segment that are included in the closed region data. Further, a sewing endpoint which is defined in S406 needs only to be last in sewing order in a preceding unit pattern. Accordingly, position data of the sewing endpoint may be defined as that of a point to be sewn immediately after the expected endpoint, or the sewing endpoint may be defined so that the expected endpoint would not be sewn.

As described above, the processing different from the first embodiment is performed in S40. In S17 in FIG. 18, the CPU 51 refers to a sewing endpoint acquired in S406, to determine whether the sewing endpoint in the preceding unit pattern is present in a sewing region of the target unit pattern.

According to the fourth embodiment described above, it is possible to automatically set this sewing endpoint in such a manner as to avoid thread-cutting operation at the sewing endpoint in the preceding unit pattern as much as possible.

The above-described first through fourth embodiments perform thread-cutting determination in a preceding unit pattern based on whether a sewing endpoint of the preceding unit pattern is present in a sewing region of a target unit pattern. This method has an advantage that it is possible to perform appropriate thread-cutting determination of no-thread-cutting if thread-cutting is unnecessary because unit patterns connected to each other in sewing order are partially overlapped with each other. On the other hand, in a case where connected unit patterns are not partially overlapped with each other, it is determined to perform thread-cutting operation, even if an embroidery finish is not affected significantly without thread-cutting, because the unit patterns are sufficiently close to each other. Therefore, the following fifth embodiment may be employed. The following will describe a flow of processing in the fifth embodiment with reference to FIGS. 20 and 21. It is to be noted that a physical and an electrical configuration of an embroidery data creation apparatus in the fifth embodiment are the same as those of the first embodiment except for storage areas of a RAM. Thus, the different storage areas of the RAM will be described later and description of the same configurations as those of the first embodiments will be omitted. Further, similar to the case of the first embodiment, an embroidery data creation apparatus 41 will be described as provided separately from an embroidery sewing machine.

Figure 31:
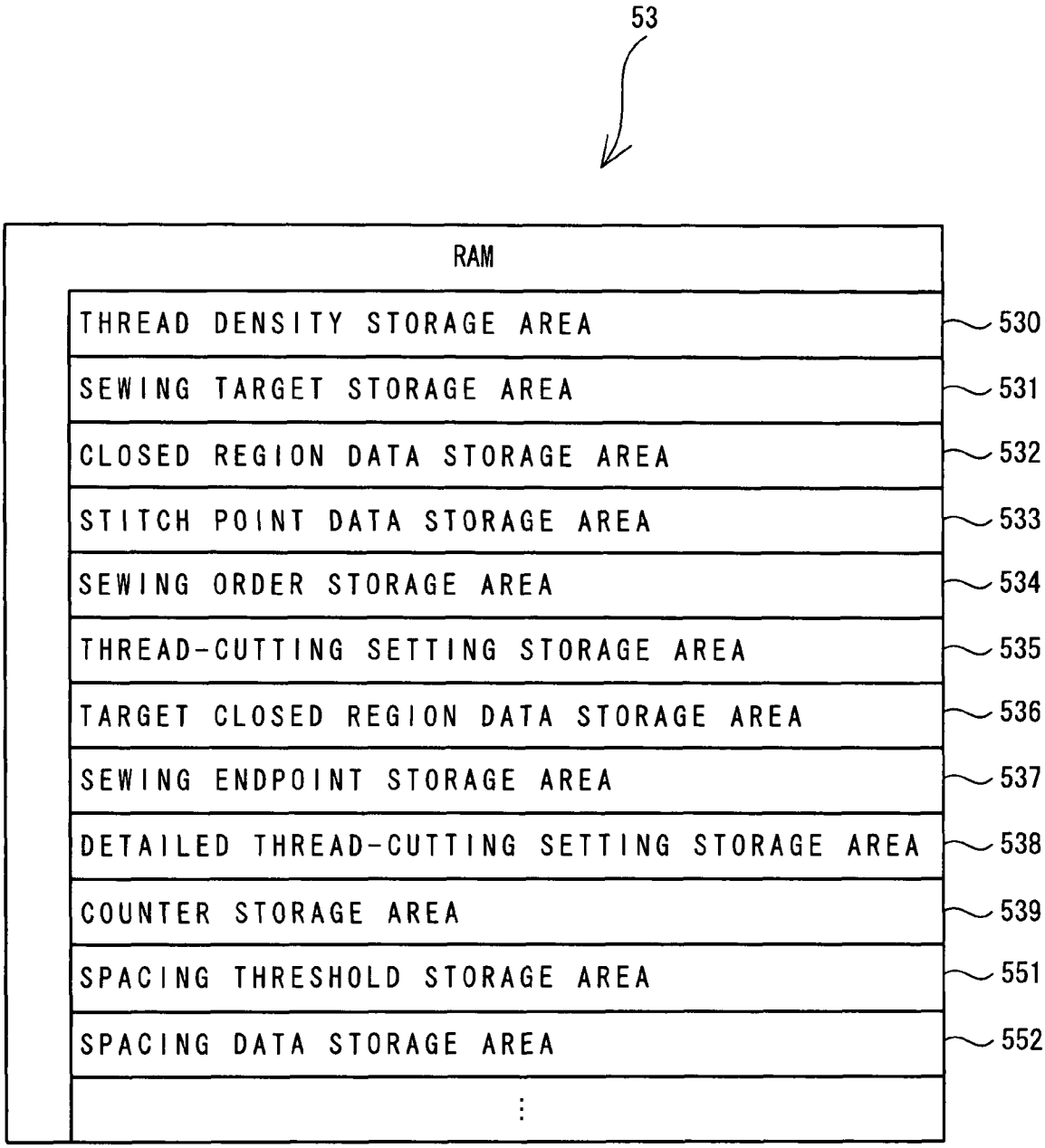
FIG. 31 is an explanatory diagram of storage areas of the RAM.

First, storage areas of a RAM 53 different from those of the first embodiment will be described with reference to FIG. 31. As shown in FIG. 31, in addition to the storage areas of the RAM 53 of the first embodiment shown in FIG. 8, there are provided a spacing threshold storage area 551 which stores a predetermined value (threshold) which is used in thread-cutting determination, a spacing data storage area 552 which stores data on spacing between a preceding unit pattern and a target unit pattern, and the like.

Figure 20:
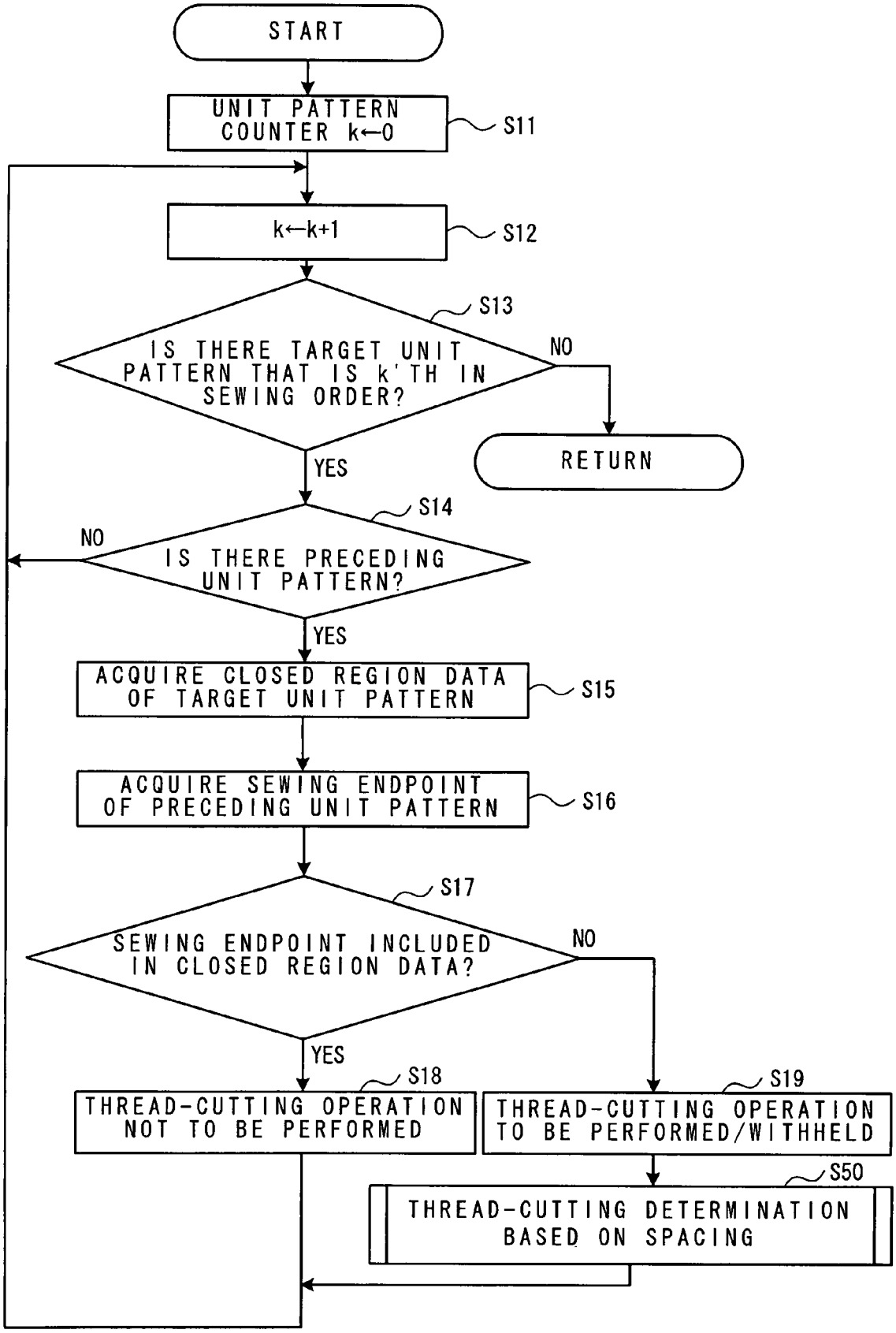
FIG. 20 is a flowchart showing a flow of setting of thread-cutting operations.
Figure 21:
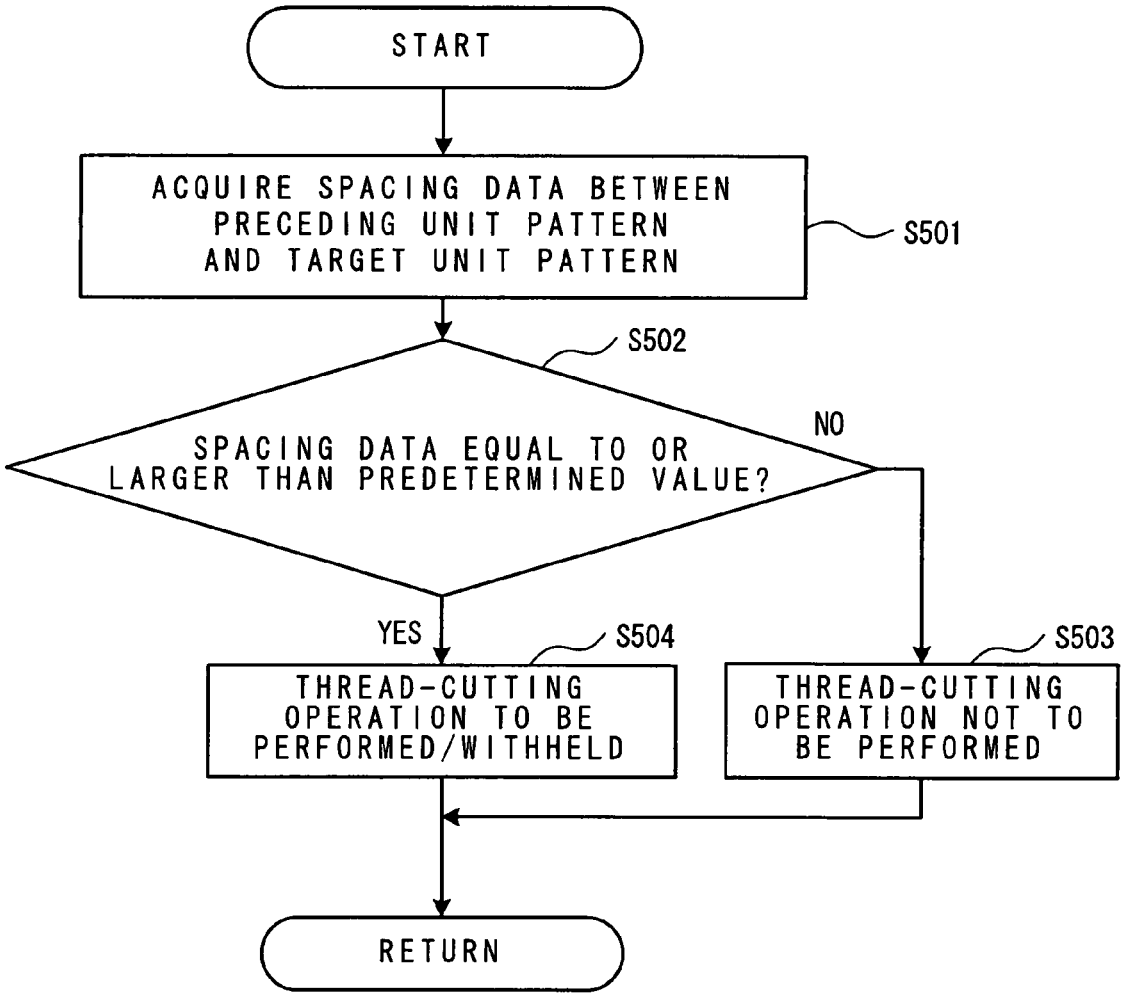
FIG. 21 is a sub-flowchart showing setting of thread-cutting operation based on spacing.

The following will describe a flow of thread-cutting determination (S5 of FIG. 9) in the fifth embodiment with reference to FIGS. 20 and 21. As shown in FIG. 20, the flow of embroidery data creation processing in the fifth embodiment is different from that of the first embodiment in processing in S50. The following will describe the different processing in S50 with reference to FIG. 21, while description of processing common to the first and fifth embodiments will be omitted. The program that performs the thread-cutting determination shown in FIGS. 20 and 21 is stored beforehand in an embroidery data creation program storage area 525 in a ROM 52 and executed by a CPU 51 shown in FIG. 6.

In the fifth embodiment, thread-cutting setting is determined again, based on whether data on spacing between a target unit pattern and a preceding unit pattern, for which thread-cutting operation was determined to be performed or withheld in S17, is equal to or larger than a predetermined value. Accordingly, in S501, the CPU 51 acquires data on spacing between the preceding unit pattern and the target unit pattern and stores it in a spacing data storage area 552 in a RAM 53. As this spacing data, arbitrary spacing data for deciding whether a finish is affected may be employed. For example, a shortest distance between a sewing endpoint of the preceding unit pattern and the target unit pattern, or a distance between the sewing endpoint of the preceding unit pattern and a sewing starting point of the target unit pattern may be used as the spacing data.

Subsequently, the CPU 51 determines whether a value of the spacing data acquired in S501 and stored in the RAM 53 by the CPU 51 is equal to or larger than the predetermined value (S502). This predetermined value may be defined beforehand and stored in a spacing threshold storage area 551 in the RAM 53 or may be entered by an operator each time embroidery data is created, and stored in the spacing threshold storage area 551. If it is determined in S502 that the spacing value is less than the predetermined value (NO at S502), the CPU 51 determines thread-cutting operation at a sewing endpoint of the preceding unit pattern not to be performed (S503), and stores a result of the determination in a thread-cutting setting storage area 535. Then, the CPU 51 proceeds to S12 of a flowchart of thread-cutting determination shown in FIG. 20. In this processing, it is also possible to determine thread-cutting operation not to be performed, if it is determined that spacing between unit patterns is so small that an embroidery finish is not affected without thread-cutting. On the other hand, if this spacing value is equal to or larger than the predetermined value (YES at S502), thread-cutting operation is set to be performed or withheld at the sewing endpoint of the preceding unit pattern (S504) and the result is stored in the thread-cutting setting storage area 535. Then, the CPU 51 returns to the flowchart shown in FIG. 20 and returns to S12 to repeat the processing.

As described above, the processing different from the first embodiment is performed in S50. It is to be noted that whether thread-cutting operation is set to be performed or to be withheld in S504 is based on information stored in a detailed thread-cutting setting storage area 538 of storage areas in the RAM 53. Whether thread-cutting operation is set to be performed or withheld in S504 may be determined beforehand and stored in the detailed thread-cutting setting storage area 538 in the RAM 53. Alternatively, it may be set by the operator each time embroidery data is created and stored in the detailed thread-cutting setting storage area 538 in the RAM 53. Further, whether thread-cutting operation is set to be performed or withheld in S504 need not be the same as determined in S19. Further, although whether the spacing value is equal to or larger than the predetermined value is determined in S502, the determination may be made based on whether it is larger than the predetermined value. In this case, if this spacing value is not larger than the predetermined value (NO at S502), thread-cutting operation at the sewing endpoint in the preceding unit pattern is set not to be performed in S503. On the other hand, if this spacing value is larger than the predetermined value (YES at S502), thread-cutting operation at the sewing endpoint in the preceding unit pattern is set to be performed or withheld in S504.

According to the fifth embodiment described above, it is possible to automatically make more appropriate determination for thread-cutting, considering an embroidery finish due to occurrence of a jump stitch, an increase in embroidery time owing to thread-cutting, and labor required by thread disposal.

It is to be noted that the present disclosure is not limited to the above-detailed embodiments and can be changed variously. First, in the first through fifth embodiments, whether or not thread-cutting operation is to be performed was determined based on closed region data of a target unit pattern and position data of a sewing endpoint of a preceding unit pattern as shown in FIGS. 10, 14, 16, 18, and 20 (S17). However, the data which is used in thread-cutting determination in S17 is not limited to them, and any information can be employed that enables comparison in terms of positional relationship between the sewing endpoint of the preceding unit pattern and a sewing region of the target unit pattern.

Although the embroidery data creation apparatus of the first embodiment was equipped with the input device, the embroidery data creation apparatus need not be equipped with the input device if a sewing target is stored beforehand in the storage device of the embroidery data creation apparatus or if it is supplied from an external storage device such as a memory card. Furthermore, the input device of the present disclosure needs only to be an interface to supply at least a unit pattern to the storage device. Therefore, the input device that can be employed may include devices that interacts with the operator, such as a track ball, a touch panel, and a voice input device, as well as the input button 13, the keyboard 43, the mouse 44, and the image scanner 47 given in the first embodiment.

Although the embroidery data creation apparatus of the first embodiment has performed thread-cutting determination in S5 of the main processing shown in FIG. 9, the present disclosure is not limited to it. For example, it is possible to omit S1-S4 of the main processing shown in FIG. 9 if, for example, information about closed region data, a stitch point, and sewing order of a sewing target is stored beforehand in the storage device in the embroidery data creation apparatus or if it is supplied to the embroidery data creation apparatus from an external storage device such as a memory card. In such cases, the embroidery data creation apparatus need not have a storage area such as the closed region data storage area 226 shown in FIG. 3 or the closed region data storage area 526 shown in FIG. 7 for storing closed region data for each unit pattern beforehand.

Although the embroidery data creation apparatus of the fourth embodiment has applied the processing of acquiring a sewing endpoint of a preceding unit pattern (S40) shown in FIGS. 18 and 19 to the first embodiment shown in FIG. 10, the present disclosure is not limited to it. For example, it is possible to apply it to the second embodiment shown in FIG. 14 or the third embodiment shown in FIG. 16. In such cases, it is possible to apply the processing in S40 shown in FIG. 18 to the processing to acquire a sewing endpoint of the preceding unit pattern in S16 shown in FIG. 14 or FIG. 16.

Further, the embroidery data creation apparatus of the fifth embodiment has applied thread-cutting determination processing based on spacing in S50 shown in FIG. 20 to the first embodiment shown in FIG. 10, if thread-cutting operation is once determined to be performed or withheld in S17. Alternatively, the processing in S50 can be applied to the second embodiment shown in FIG. 14, the third embodiment shown in FIG. 16, or the fourth embodiment shown in FIG. 18. In such cases, it is possible to apply the thread-cutting determination based on spacing in S50 shown in FIG. 20 as processing to be inserted between S19 in FIG. 14, FIG. 16 or FIG. 18 to determine whether thread-cutting operation is to be performed or withheld at a sewing endpoint of the preceding unit pattern and S12 to increment the value of the unit pattern counter k.

In an embroidery data creation apparatus of the present disclosure, when sewing a plurality of unit patterns, a first determination device determines whether a sewing endpoint of a preceding unit pattern to be sewn immediately prior to a target unit pattern is present in a sewing region of the target unit pattern. Then, a first thread-cutting setting device automatically performs thread-cutting setting for each of the unit patterns in a condition where it is correlated with the determination result of the first determination device. Accordingly, if it is unnecessary to perform thread-cutting operation because the unit patterns successive to each other in sewing order are partially overlapped with each other, this first determination device determines that the sewing endpoint of the preceding unit pattern is present in the sewing region of the target unit pattern. Based on this determination, the first thread-cutting setting device sets thread-cutting operation at the sewing endpoint of the preceding unit pattern not to be performed. An embroidery sewing machine, which performs sewing based on embroidery data, performs sewing without cutting a thread at the sewing endpoint of the preceding unit pattern for which thread-cutting operation has been set not to be performed, in accordance with the setting by the embroidery data creation apparatus. A portion between this sewing endpoint of the preceding unit pattern for which thread-cutting operation has been set not to be performed and a sewing starting point of the target unit pattern is sewn by one-stitch sewing or running stitch sewing. As a result, a sewing thread that occurs between the sewing endpoint and the sewing starting point is masked because the sewing region of the target unit pattern is sewn by the embroidery sewing machine.

In such a manner, according to the embroidery data creation apparatus of the present disclosure, thread-cutting operation at a sewing endpoint of each of unit patterns can be set rapidly and accurately, thereby reducing the number of times of cutting a thread between the unit patterns without affecting a finish of embroidery. Further, at a stage of embroidery, labor for disposal of cut threads can be mitigated, thereby reducing sewing time. Furthermore, in the embroidery data creation apparatus of the present disclosure, it is unnecessary to create or modify information required for thread-cutting setting for each of character attributes, thereby enabling rapidly accommodating addition or modification of the character attributes.

Further, the embroidery data creation apparatus of the present disclosure has an input device that inputs a unit pattern to be sewn and so can determine the thread-cutting setting for a unit pattern immediately after this unit pattern is input into the embroidery data creation apparatus. Therefore, it is possible to rapidly set thread-cutting operation for each of the unit patterns as compared to a case where the input means is provided separately from the embroidery data creation apparatus.

Further, in the embroidery data creation apparatus of the present disclosure, the first determination device determines whether sewing endpoint data, which is embroidery position data of the sewing endpoint of the preceding unit pattern, is included in closed region data of a target unit pattern. This closed region data is widely used in art as embroidery data of the unit pattern. This closed region data includes position data about relative or absolute coordinates of a region to be filled with stitches made by the embroidery sewing machine. Therefore, by using this closed region data and the sewing endpoint data of the preceding unit pattern, it is possible to easily determine whether a sewing endpoint of a preceding unit pattern is present in a sewing region of a target unit pattern. Further, as for embroidery data utilizing closed region data already, existing data can be used as data to be supplied to the first determination device, thereby automatically performing appropriate thread-cutting setting without adding new data for each of the unit patterns.

Further, in the embroidery data creation apparatus of the present disclosure, if a target unit pattern is composed of partial patterns having different sewing starting points, the first determination device determines by referring to closed region data of a sewing region of the first partial pattern that is first in sewing order in the target unit pattern. Accordingly, appropriate thread-cutting setting can be performed considering sewing order of the partial patterns. In this case, the first determination device needs to refer only to the closed region data of the sewing region of the first partial pattern and so can determine thread-cutting setting rapidly as compared to the case of making determination by referring to all of the closed region data pieces of the target unit pattern.

Further, in the embroidery data creation apparatus of the present disclosure, if a target unit pattern is composed of partial patterns having different sewing starting points, the first determination device refers to closed region data of a partial pattern sewing region where the first partial pattern is sewn and closed region data of a connected sewing region where the partial pattern connected to this partial pattern sewing region is sewn. It is thus possible to perform thread-cutting setting in such a manner as not to cut threads as much as possible at a sewing endpoint of a preceding unit pattern without affecting an embroidery finish considering the sewing order of the partial patterns. Further, thread-cutting determination can be made rapidly as compared to the case of determining whether a sewing endpoint of the preceding unit pattern is included in all of closed region data pieces of the target unit pattern by referring to these data pieces.

Further, in the embroidery data creation apparatus of the present disclosure, a second determination device determines whether any one of points on a line segment interconnecting an expected endpoint of a preceding unit pattern and a stitch point to be sewn immediately prior to this expected endpoint is included in closed region data of a sewing region of a target unit pattern. In a case where it is determined by the second determination device that any one of the points on the line segment is included in the closed region data, even if position data of the expected endpoint of the preceding unit pattern is not included in the closed region data, a sewing endpoint setting device sets the sewing endpoint of the preceding unit pattern to any one of the points on the line segment included in the closed region data. Therefore, it is possible to automatically set this sewing endpoint in such a manner as not to cut threads as much as possible at the sewing endpoint of the previous unit pattern.

Further, in the embroidery data creation apparatus of the present disclosure, a preceding unit pattern, for which thread-cutting operation has been set to be performed or withheld by the first thread-cutting setting device, is subjected to thread-cutting setting again by a second thread-cutting setting device. Accordingly, for example, even if a sewing endpoint of a preceding unit pattern is not present in a sewing region of a target unit pattern and thread-cutting operation has been set to be performed or withheld by the first thread-cutting setting device, it is possible to reset thread-cutting operation not to be performed by using the second thread-cutting setting device if it is determined that an embroidery finish is not affected significantly due to small spacing between the preceding unit pattern and the target unit pattern. In such a manner, according to the present disclosure, it is possible to automatically perform appropriate thread-cutting determination considering an embroidery finish due to occurrence of a jump stitch, an increase in sewing time owing to thread cutting, and labor required for thread disposal.

In an embroidery data creation program of the present disclosure, when sewing a plurality of unit patterns, in a first determination step it is determined whether a sewing endpoint of a preceding unit pattern to be sewn immediately prior to a target unit pattern is present in a sewing region of the target unit pattern. Then, in a first thread-cutting setting step, thread-cutting setting for each of the unit patterns is automatically performed in a condition where it is correlated with a result of the determination in the first determination step. Accordingly, if it is unnecessary to perform thread-cutting operation because the successive unit patterns in sewing order are partially overlapped with each other, it is determined in this first determination step that the sewing endpoint of the preceding unit pattern is present in the sewing region of the target unit pattern. Based on this determination, in the first thread-cutting setting step, thread-cutting operation at the sewing endpoint of the preceding unit pattern is set not to be performed. An embroidery sewing machine, which performs sewing based on embroidery data, performs sewing without cutting a thread at the sewing endpoint of the preceding unit pattern for which thread-cutting operation has been set not to be performed, in accordance with the setting by the embroidery data creation program of the present disclosure. A portion between this sewing endpoint of the preceding unit pattern for which thread-cutting operation has been set not to be performed and a sewing starting point of the target unit pattern is sewn by one-stitch sewing or running stitch sewing. As a result, a sewing thread that occurs between this sewing endpoint and this sewing starting point is masked because the sewing region of the target unit pattern is sewn by the embroidery sewing machine.

In such a manner, according to the embroidery data creation program of the present disclosure, thread-cutting operation at a sewing endpoint of each of unit patterns can be set rapidly and accurately, thereby reducing the number of times of cutting a thread between the unit patterns without affecting a finish of embroidery. Further, at a stage of embroidery, labor for disposal of cut threads can be mitigated, thereby reducing sewing time. Furthermore, in the embroidery data creation program of the present disclosure, it is unnecessary to create or modify information required for thread-cutting setting for each of character attributes, thereby enabling rapidly accommodating addition and modification of the character attributes.

Further, the embroidery data creation program of the present disclosure has an input step in which a unit pattern to be sewn is input and so thread-cutting setting for a unit pattern can be determined immediately after this unit pattern is input into the embroidery data creation apparatus. Therefore, it is possible to rapidly set thread-cutting operation for each of the unit patterns as compared to a case where the input step is not provided.

Further, in the embroidery data creation program of the present disclosure, in the first determination step, it is determined whether sewing endpoint data, which is embroidery position data of said sewing endpoint of the preceding unit pattern, is included in closed region data of a target unit pattern. This closed region data is widely used in art as embroidery data of the unit pattern. This closed region data includes position data about relative or absolute coordinates of a region to be filled with stitches made by the embroidery sewing machine. Therefore, by using this closed region data and the sewing endpoint data of the preceding unit pattern, it is possible to easily determine whether a sewing endpoint of a preceding unit pattern is present in a sewing region of a target unit pattern. Further, as for embroidery data utilizing closed region data already, existing data can be used in the first determination step, thereby automatically performing appropriate thread-cutting setting without adding new data for each of the unit patterns.

Further, in the embroidery data creation program of the present disclosure, if a target unit pattern is composed of partial patterns having different sewing starting points, in the first determination step determination is made by referring to closed region data of a sewing region of the first partial pattern that is first in sewing order in the target unit pattern. Accordingly, appropriate thread-cutting setting can be performed considering sewing order of the partial patterns. In this case, in the first determination step only the closed region data of the sewing region of the first partial pattern needs to referred to and so thread-cutting setting can be determined rapidly as compared to the case of making determination by referring to all of the closed region data pieces of the target unit pattern.

Further, in the embroidery data creation program of the present disclosure, if a target unit pattern is composed of partial patterns having different sewing starting points, in the first determination step, closed region data of a partial pattern sewing region where the first partial pattern is sewn and closed region data of a connected sewing region where the partial pattern connected to this partial pattern sewing region is sewn are referred to. It is thus possible to perform thread-cutting setting in such a manner as not to cut threads as much as possible at a sewing endpoint of a preceding unit pattern without affecting an embroidery finish, taking into account the sewing order of the partial patterns. Further, thread-cutting determination can be made rapidly as compared to the case of determining whether a sewing endpoint of the preceding unit pattern is included in all of closed region data pieces of the target unit pattern.

Further, in the embroidery data creation program of the present disclosure, in a second determination step it is determined whether any one of points on a line segment interconnecting an expected endpoint of a preceding unit pattern and a stitch point to be sewn immediately prior to this expected endpoint is included in closed region data of a sewing region of a target unit pattern. In a case where it is determined that any one of the points on the line segment is included in the closed region data, even if position data of the expected endpoint of the preceding unit pattern is not included in the closed region data, in a sewing endpoint setting step the sewing endpoint of the preceding unit pattern is set to any one of the points on the line segment included in the closed region data. Therefore, it is possible to automatically set this sewing endpoint in such a manner as not to cut threads as much as possible at the sewing endpoint of the preceding unit pattern.

Further, in the embroidery data creation program of the present disclosure, a preceding unit pattern for which thread-cutting operation has been set to be performed or withheld in the first thread-cutting setting step is subjected to thread-cutting setting again in a second thread cutting setting step. Accordingly, for example, even if a sewing endpoint of a preceding unit pattern is not present in a sewing region of a target unit pattern and thread-cutting operation has been set to be performed or withheld in the first thread cutting setting step, it is possible to reset thread-cutting operation not to be performed in the second thread cutting setting step if it is determined that an embroidery finish is not affected significantly due to small spacing between the preceding unit pattern and the target unit pattern. In such a manner, according to the present disclosure, it is possible to automatically perform more appropriate thread-cutting determination, considering an embroidery finish due to occurrence of a jump stitch, an increase in embroidery time owing to thread-cutting, and labor required for thread disposal.

In an embroidery data creation apparatus of the present disclosure, when sewing a plurality of unit patterns, a control device first determines whether a sewing endpoint of a preceding unit pattern to be sewn immediately prior to a target unit pattern is present in a sewing region of the target unit pattern. Then, the control device automatically performs thread-cutting setting for each of the unit patterns in a condition where it is correlated with a result of the determination. Accordingly, if it is unnecessary to perform thread-cutting operation because the unit patterns successive to each other in sewing order are partially overlapped with each other, it is determined by this control device that the sewing endpoint of the preceding unit pattern is present in the sewing region of the target unit pattern. Based on this determination, the control device sets thread-cutting operation at the sewing endpoint of the preceding unit pattern not to be performed. In such a manner, according to the embroidery data creation apparatus of the present disclosure, thread-cutting operation at a sewing endpoint of each of unit patterns can be set rapidly and accurately, thereby reducing the number of times of cutting a thread between the unit patterns without affecting a finish of embroidery. Further, at a stage of embroidery, labor for disposal of cut threads can be mitigated, thereby reducing sewing time. Furthermore, in the embroidery data creation apparatus of the present disclosure, it is unnecessary to create or modify information required for thread-cutting setting for each of character attributes, thereby enabling rapidly accommodating addition and modification of the character attributes.

Further, in the embroidery data creation apparatus of the present disclosure, the control device determines whether sewing endpoint data, which is embroidery position data of said sewing endpoint of the preceding unit pattern, is included in closed region data of a target unit pattern. This closed region data is widely used in art as embroidery data of the unit pattern. This closed region data includes position data about relative or absolute coordinates of a region to be filled with stitches made by the embroidery sewing machine. Therefore, by using this closed region data and the sewing endpoint data of the preceding unit pattern, it is possible to easily determine whether a sewing endpoint of a preceding unit pattern is present in a sewing region of a target unit pattern. Further, as for embroidery data utilizing closed region data already, the control device can use existing data, thereby automatically performing appropriate thread-cutting setting without adding new data for each of the unit patterns.

Further, in the embroidery data creation apparatus of the present disclosure, if a target unit pattern is composed of partial patterns having different sewing starting points, the control device makes determination by referring to closed region data of a sewing region of the first partial pattern that is first in sewing order in the target unit pattern. Accordingly, appropriate thread-cutting setting can be performed, considering sewing order of the partial patterns. In this case, in determination, the control device needs to refer only to the closed region data of the sewing region of the first partial pattern and so can determine thread-cutting setting rapidly as compared to the case of making determination by referring to all of the closed region data pieces of the target unit pattern.

Further, in the embroidery data creation apparatus of the present disclosure, if a target unit pattern is composed of partial patterns having different sewing starting points, the control device refers to closed region data of a partial pattern sewing region where the first partial pattern is sewn and closed region data of a connected sewing region where the partial pattern connected to this partial pattern sewing region is sewn. It is thus possible to perform thread-cutting setting in such a manner as not to cut threads as much as possible at a sewing endpoint of a preceding unit pattern without affecting an embroidery finish, considering the sewing order of the partial patterns. Further, thread-cutting determination can be made rapidly as compared to the case of determining whether a sewing endpoint of the preceding unit pattern is included in all of closed region data pieces of the target unit pattern.

Further, in the embroidery data creation apparatus of the present disclosure, the control device determines whether any one of points on a line segment interconnecting an expected endpoint of a preceding unit pattern and a stitch point to be sewn immediately prior to this expected endpoint is included in closed region data of a sewing region of a target unit pattern. In a case where it is determined that any one of the points on the line segment is included in the closed region data, even if position data of the expected endpoint of the preceding unit pattern is not included in the closed region data, the control device sets the sewing endpoint of the preceding unit pattern to any one of the points on the line segment included in the closed region data. Therefore, it is possible to automatically set this sewing endpoint in such a manner as not to cut threads as much as possible at the sewing endpoint of the preceding unit pattern.

Further, in the embroidery data creation apparatus of the present disclosure, a preceding unit pattern for which thread-cutting operation has previously been set to be performed or withheld is subjected to thread-cutting setting again by the control device. Accordingly, for example, even if a sewing endpoint of a preceding unit pattern is not present in a sewing region of a target unit pattern and thread-cutting operation has been set by the control device to be performed or withheld previously, it is possible to reset thread-cutting operation not to be performed by the control device, if it is determined that an embroidery finish is not affected significantly due to small spacing between the preceding unit pattern and the target unit pattern. In such a manner, according to the present disclosure, it is possible to automatically perform appropriate thread-cutting determination, considering an embroidery finish due to occurrence of a jump stitch, an increase in sewing time owing to thread-cutting, and labor required for thread disposal.

What is claimed is:

1. An embroidery data creation apparatus that creates embroidery data required to embroider a plurality of unit patterns by using an embroidery sewing machine, said apparatus comprising:

a storage device that stores said unit patterns, each of said unit patterns being made up of one character or symbol;

a first determination device that determines whether a sewing endpoint exists in a sewing region of a target unit pattern, said sewing endpoint being last in sewing order of a plurality of stitch points of a preceding unit pattern to be sewn immediately prior to said target unit pattern, and said target unit pattern being one of said unit patterns stored in said storage device; and a first thread-cutting setting device that, if it has been determined by said first determination device that said sewing endpoint of said preceding unit pattern exists in said sewing region of said target unit pattern, sets a thread-cutting operation not to be performed by a thread-cutting mechanism in an embroidery sewing machine at said sewing endpoint of said preceding unit pattern and, if it has been determined by said first determination device that said sewing endpoint of said preceding unit pattern does not exist in said sewing region of said target unit pattern, sets the thread-cutting operation to be performed or withheld, wherein said first determination device determines whether sewing endpoint data, which is embroidery position data of said sewing endpoint of said preceding unit pattern, is included in a closed region data, which is embroidery position data of one or a plurality of closed regions obtained by dividing said sewing region of said target unit pattern, to thereby determine whether said sewing endpoint of said preceding unit pattern is present in said sewing region of said target unit pattern.

2. The embroidery data creation apparatus according to claim 1, further comprising an input device that inputs said unit patterns, wherein said storage device stores said unit patterns input through said input device.

3. The embroidery data creation apparatus according to claim 1, wherein, if said target unit pattern is composed of a plurality of partial patterns having different sewing starting points, said first determination device determines whether said sewing endpoint data of said preceding unit pattern is included in said closed region data of said sewing region of a first partial pattern that is first in sewing order in said target unit pattern.

4. The embroidery data creation apparatus according to claim 1, wherein, if said target unit pattern is composed of a plurality of partial patterns having different sewing starting points, said first determination device determines whether said sewing endpoint data of said preceding unit pattern is included in said closed region data of any of a partial pattern sewing region and a connected sewing region, said partial pattern sewing region being said sewing region of a first partial pattern that is first in sewing order in said target unit pattern, and said connected sewing region being said sewing region of the partial pattern connected to said partial pattern sewing region.

5. The embroidery data creation apparatus according to claim 1, comprising:

a second determination device that determines whether position data of an arbitrary point on a line segment interconnecting an expected endpoint and said stitch point to be sewn immediately prior to said expected endpoint, said expected endpoint being a candidate of said stitch point that is last in sewing order out of said stitch points in said preceding unit pattern, is included in said closed region data of said target unit pattern; and a sewing endpoint setting device that, if it is determined by said second determination device that the position data of the arbitrary point on said line segment is included in said closed region data of said target unit pattern, sets any one of the points on said line segment determined to be included in said closed region data as said sewing endpoint of said preceding unit pattern and, if it is determined by said second determination device that the position data of the arbitrary point on said line segment is not included in said closed region data of said target unit pattern, sets said expected endpoint as said sewing endpoint of said preceding unit pattern.

6. The embroidery data creation apparatus according to claim 1, further comprising:

a spacing data acquisition device that acquires a spacing data, which is information about a distance between said target unit pattern and said preceding unit pattern for which said thread-cutting operation has been set to be performed or withheld by said first thread-cutting setting device; and a second thread-cutting setting device that, if said spacing data acquired by said spacing data acquisition device is smaller than a predetermined value, resets said thread-cutting operation not to be performed for said preceding unit pattern for which said first thread-cutting setting device has set said thread-cutting operation to be performed or withheld and, if said spacing data is equal to or larger than the predetermined value, resets said thread-cutting operation to be performed or withheld for said preceding unit pattern for which said first thread-cutting setting device has set said thread-cutting operation to be performed or withheld.

7. An embroidery data creation program recorded on a computer-readable recording medium that creates embroidery data required to embroider a plurality of unit patterns by using an embroidery sewing machine, said program comprising:

instructions for executing a storage step of storing said unit patterns, each of said unit patterns being made up of one character or symbol;

instructions for executing a first determination step of determining whether a sewing endpoint exists in a sewing region of a target unit pattern, said sewing endpoint being last in sewing order of a plurality of stitch points of a preceding unit pattern to be sewn immediately prior to said target unit pattern, and said target unit pattern being one of said unit patterns stored in said storage step; and instructions for executing a first thread-cutting setting step of, if it has been determined in said first determination step that said sewing endpoint of said preceding unit pattern exists in said sewing region of said target unit pattern, setting a thread-cutting operation not to be performed by a thread cutting mechanism in an embroidery sewing machine at said sewing endpoint of said preceding unit pattern and, if it has been determined in said first determination step that said sewing endpoint of said preceding unit pattern does not exist in said sewing region of said target unit pattern, setting the thread-cutting operation to be performed or withheld, wherein said first determination step determines whether sewing endpoint data, which is embroidery position data of said sewing endpoint of said preceding unit pattern, is included in closed region data, which is embroidery position data of one or a plurality of closed regions obtained by dividing said sewing region of said target unit pattern, to thereby determine whether said sewing endpoint of said preceding unit pattern is present in said sewing region of said target unit pattern.

8. The embroidery data creation program according to claim 7, further comprising instructions for executing an input step of inputting said unit patterns, wherein said unit patterns which have been input in said input step are stored in said storage step.

9. The embroidery data creation program according to claim 7, wherein, if said target unit pattern is composed of a plurality of partial patterns having different sewing starting points, it is determined in said first determination step whether said sewing endpoint data of said preceding unit pattern is included in said closed region data of said sewing region of a first partial pattern that is first in sewing order in said target unit pattern.

10. The embroidery data creation program according to claim 7, wherein, if said target unit pattern is composed of a plurality of partial patterns having different sewing starting points, it is determined in said first determination step whether said sewing endpoint data of said preceding unit pattern is included in said closed region data of any of a partial pattern sewing region and a connected sewing region, said partial pattern sewing region being said sewing region of a first partial pattern that is first in sewing order in said target unit pattern, and said connected sewing region being said sewing region of the partial pattern connected to said partial pattern sewing region.

11. The embroidery data creation program according to claim 7, further comprising:

instructions for executing a second determination step of determining whether position data of an arbitrary point on a line segment interconnecting an expected endpoint and said stitch point to be sewn immediately prior to said expected endpoint, said expected endpoint being a candidate of said stitch point that is last in sewing order out of said stitch points in said preceding unit pattern, is included in said closed region data of said target unit pattern; and instructions for executing a sewing endpoint setting step of, if it is determined in said second determination step that the position data of the arbitrary point on said line segment is included in said closed region data of said target unit pattern, setting any one of the points on said line segment determined to be included in said closed region data as said sewing endpoint of said preceding unit pattern and, if it is determined in said second determination step that the position data of the arbitrary point on said line segment is not included in said closed region data of said target unit pattern, setting said expected endpoint as said sewing endpoint of said preceding unit pattern.

12. The embroidery data creation program according to claim 7, further comprising:

instructions for executing a spacing data acquisition step of acquiring spacing data, which is information about a distance between said target unit pattern and said preceding unit pattern for which said thread-cutting operation has been set to be performed or withheld in said first thread-cutting setting step; and instructions for executing a second thread cutting setting step of, if said spacing data acquired in said spacing data acquisition step is smaller than a predetermined value, resetting said thread-cutting operation not to be performed for said preceding unit pattern for which said thread-cutting operation has been set to be performed or withheld in said first thread-cutting setting step and, if said spacing data is equal to or larger than the predetermined value, resetting said thread-cutting operation to be performed or withheld for said preceding unit pattern for which said thread-cutting operation has been set to be performed or withheld in said first thread-cutting setting step.

13. An embroidery data creation apparatus that creates embroidery data required to embroider a plurality of unit patterns by using an embroidery sewing machine, said apparatus comprising:

a storage device that stores said unit patterns, each of said unit patterns being made up of one character or symbol;

a control device that determines whether a sewing endpoint exists in a sewing region of a target unit pattern, said sewing endpoint being last in sewing order of a plurality of stitch points of a preceding unit pattern to be sewn immediately prior to said target unit pattern, and said target unit pattern being one of said unit patterns stored in said storage device, and, if it has determined that said sewing endpoint of said preceding unit pattern exists in said sewing region of said target unit pattern, sets a thread-cutting operation not to be performed by a thread cutting mechanism in an embroidery sewing machine at said sewing endpoint of said preceding unit pattern and, if it has determined that said sewing endpoint of said preceding unit pattern does not exist in said sewing region of said target unit pattern, sets a thread-cutting operation to be performed or withheld, wherein said control device determines whether sewing endpoint data, which is embroidery position information of said sewing endpoint of said preceding unit pattern, is included in closed region data, which is embroidery position data of one or a plurality of closed regions obtained by dividing said sewing region of said target unit pattern, to thereby determine whether said sewing endpoint of said preceding unit pattern is present in said sewing region of said target unit pattern.

14. The embroidery data creation apparatus according to claim 13, further comprising an input device that inputs said unit patterns, wherein said storage device stores said unit patterns input through said input device.

15. The embroidery data creation apparatus according to claim 13, wherein, if said target unit pattern is composed of a plurality of partial patterns having different sewing starting points, said control device determines whether said sewing endpoint data of said preceding unit pattern is included in said closed region data of said sewing region of a first partial pattern that is first in sewing order in said target unit pattern.

16. The embroidery data creation apparatus according to claim 13, wherein, if said target unit pattern is composed of a plurality of partial patterns having different sewing starting points, said control device determines whether said sewing endpoint data of said preceding unit pattern is included in said closed region data of any of a partial pattern sewing region and a connected sewing region, said partial pattern sewing region being said sewing region of a first partial pattern that is first in sewing order in said target unit pattern, and said connected sewing region being said sewing region of the partial pattern connected to said partial pattern sewing region.

17. The embroidery data creation apparatus according to claim 13, wherein said control device determines whether a position data of an arbitrary point on a line segment interconnecting an expected endpoint and said stitch point to be sewn immediately prior to said expected endpoint, said expected endpoint being a candidate of said stitch point that is last in sewing order out of said stitch points in said preceding unit pattern, is included in said closed region data of said target unit pattern, and if it is determined that the position data of the arbitrary point on said line segment is included in said closed region data of said target unit pattern, sets any one of the points on said line segment determined to be included in said closed region data as said sewing endpoint of said preceding unit pattern and, if it is determined that the position data of the arbitrary point on said line segment is not included in said closed region data of said target unit pattern, sets said expected endpoint as said sewing endpoint of said preceding unit pattern.

18. The embroidery data creation apparatus according to claim 13, wherein said control device acquires a spacing data, which is information about a distance between said target unit pattern and said preceding unit pattern for which said thread-cutting operation has been set to be performed or withheld by said first thread-cutting setting device, and if said spacing data acquired is smaller than a predetermined value, resets said thread-cutting operation not to be performed for said preceding unit pattern for which said thread-cutting operation has been set to be performed or withheld and, if said spacing data is equal to or larger than the predetermined value, resets said thread-cutting operation to be performed or withheld for said preceding unit pattern for which said thread-cutting operation has been to be performed or withheld.

* * * * *